US008269800B2

(12) United States Patent
Uchino et al.

(10) Patent No.: US 8,269,800 B2
(45) Date of Patent: Sep. 18, 2012

(54) DISPLAY DEVICE AND ELECTRONIC APPARATUS

(75) Inventors: Katsuhide Uchino, Kanagawa (JP); Tetsuro Yamamoto, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 927 days.

(21) Appl. No.: 12/068,396

(22) Filed: Feb. 6, 2008

(65) Prior Publication Data

US 2008/0198182 A1 Aug. 21, 2008

(30) Foreign Application Priority Data

Feb. 19, 2007 (JP) ..... 2007-037379

(51) Int. Cl.
*G09G 5/10* (2006.01)
*G09G 3/36* (2006.01)

(52) U.S. Cl. ..... 345/690; 345/98

(58) Field of Classification Search ..... 345/98, 345/690

See application file for complete search history.

(56) References Cited

U.S. PATENT DOCUMENTS 5,684,365 A 11/1997 Tang et al.
2006/0066534 A1 * 3/2006 Shirasaki et al. ..... 345/76
2007/0001958 A1 * 1/2007 Lee et al. ..... 345/92

FOREIGN PATENT DOCUMENTS

JP 08-234683 9/1996

* cited by examiner

*Primary Examiner* — Quan-Zhen Wang
*Assistant Examiner* — Nelson D Runkle, III
(74) *Attorney, Agent, or Firm* — Rader Fishman & Grauer, PLLC

(57) ABSTRACT

With a source voltage of a transistor driving a light emitting element set to a fixed voltage, variations in an emission luminance due to variations in the threshold voltage of the transistor are corrected. The fixed voltage is set in accordance with a signal level of a drive pulse signal on-off controlling a transistor supplying power to the first transistor.

12 Claims, 23 Drawing Sheets

RELATED ART

RELATED ART

DISPLAY DEVICE AND ELECTRONIC APPARATUS

CROSS REFERENCES TO RELATED APPLICATIONS

The present invention contains subject matter related to Japanese Patent Application JP 2007-037379 filed in the Japanese Patent Office on Feb. 19, 2007, the entire contents of which are incorporated herein by reference.

BACKGROUND OF THE INVENTION

1. Field of the Invention

The present invention relates to display devices and, in particular, a current-driven, self-luminous display device such as an electro-luminescence element. More particularly, the present invention relates to a self-luminous display device having a smaller number of pattern lines for a fixed voltage, in which a source voltage of a transistor driving a light emitting element is set to a fixed voltage to correct variations in emission luminance due to variations in a threshold voltage value of the transistor, and the fixed voltage is set by a signal level of a drive pulse signal on-off controlling a transistor supplying the first transistor with power.

2. Description of the Related Art

A variety of techniques have been introduced in display devices employing an organic electroluminescence (EL) element as discussed in U.S. Pat. No. 5,684,365 and Japanese Unexamined Patent Application Publication No. 8-234683.

FIG. 15 is a block diagram illustrating an active-matrix display device 1 employing an organic EL element of related art. A pixel section 2 in the display device 1 includes a matrix of pixels (PX) 3. A scanning line (SCN) runs in a substantially horizontal direction along each row of pixels 3 arranged in a matrix configuration, and signal lines SIG run substantially in perpendicular to the scanning lines SCN along each column of the pixels.

As shown in FIG. 16, each pixel 3 includes an organic EL element 8 as a current-driven self-luminous element and a driver circuit for each pixel 3 driving the organic EL element 8 (hereinafter referred to as a pixel circuit).

In the pixel circuit, one terminal of a signal level maintaining capacitor C1 is maintained at a constant voltage level, and the other terminal of the signal level maintaining capacitor C1 is connected to a signal line SIG via a transistor TR1 that is turned on and off in response to a write signal WS. In the pixel circuit, the transistor TR1 is turned on at a rising edge of the write signal WS, the other terminal of the signal level maintaining capacitor C1 is set to a signal level of the signal line SIG, and the signal level of the signal line SIG is sample-held to the other terminal of the signal level maintaining capacitor C1 at a timing the transistor TR1 is transitioned from an on state to an off state.

In the pixel circuit, the other terminal of the signal level maintaining capacitor C1 is connected to a gate of a P-channel transistor TR2 having a source connected to a power source Vcc. The drain of the transistor TR2 is connected to an anode of the organic EL element 8. The pixel circuit is set so that the transistor TR2 always operates in a saturation state. As a result, the transistor TR2 forms a constant current circuit operating at a drain-source current Ids represented by the following equation (1):

$$Ids=\tfrac{1}{2}\times\mu\times W/L\times Cox(Vgs-Vth)^2 \quad (1)$$

where Vgs is a gate-source voltage of the transistor TR2 and μ is a mobility, W is a channel width, L is a channel length, Cox is a gate capacitance, and Vth is a threshold voltage of the transistor TR2. In the pixel circuit, the organic EL element 8 is driven by the drive current Ids responsive to the signal level of the signal line SIG sample-held by the signal level maintaining capacitor C1.

The display device 1 generates the write signal WS, as a timing signal for commanding writing to each pixel 3, by successively transferring predetermined sampling pulses with a write-scan circuit (WSCN) in a vertical driver circuit 4. A horizontal selector (HSEL) 5A in a horizontal driver circuit 5 generates a timing signal by successively transferring predetermined sampling pulses and sets each signal line SIG to the signal level of an input signal Si with respect to the timing signal. The display device 1 sets the terminal voltage of the signal level maintaining capacitor C1 in each pixel section 2 in response to the input signal S1 on a dot-by-dot basis or on a line-by-line basis and then displays an image responsive to the input signal S1.

As shown in FIG. 17, current-voltage characteristics of the organic EL element 8 age with time in a direction that current flowing becomes difficult. In FIG. 17, label L1 represents initial characteristics and label L2 represents aged characteristics. In the pixel circuit of FIG. 16, the P-channel transistor TR2 drives the organic EL element 8. In such a case, the transistor TR2 drives the organic EL element 8 in response to the gate-source voltage Vgs set at the signal level of the signal line SIG. Luminance change in each pixel due to aged current-voltage characteristics is prevented.

If the pixel circuit, the horizontal driver circuit 5 and the vertical driver circuit 4 are all constructed of N-channel transistors, these circuits may be fabricated together on an insulating substrate such as a glass substrate in an amorphous silicon process. The display device is thus easily manufactured.

In the comparison of FIG. 18 with FIG. 16, each pixel 13 is fabricated of an N-channel transistor TR2, and a display device 11 is manufactured of pixel sections 12, each including the pixel 13. With the source of the transistor TR2 connected to the organic EL element 8, the gate-source voltage Vgs of the transistor TR2 changes in response to a change in the current-voltage characteristics of FIG. 17. In this case, the current flowing through the organic EL element 8 becomes gradually smaller with time and luminance of each pixel 13 becomes gradually lower. As shown in FIG. 18, emission luminance also varies from pixel to pixel in accordance with variations in the characteristics of the transistor TR2. The variations in the emission luminance disturbs uniformity of a display screen. A user may notice resulting non-uniformity on the display screen.

A circuit arrangement of FIG. 19 has been proposed to control a drop in the emission luminance due to aging of the organic EL element and variations in the emission luminance due to variations in the characteristics of the transistor.

In a display device 21 of FIG. 19, a pixel section 22 includes a matrix of pixels 23. In the pixel 23, one terminal of the signal level maintaining capacitor C1 is connected to an anode of the organic EL element 8 and the other terminal of the signal level maintaining capacitor C1 is connected to the signal line SIG via the transistor TR1 that is turned on and off in response to the write signal WS. In the pixel 23, the voltage of the other terminal of the signal level maintaining capacitor C1 is set to the signal level of the signal line SIG in response to the write signal WS.

In the pixel 23, the two terminals of the signal level maintaining capacitor C1 are respectively connected to the source and the gate of the transistor TR2. The drain of the transistor TR2 is connected to the power source Vcc via the transistor TR3 that is turned on and off in response to a drive pulse signal DS. The organic EL element 8 in the pixel 23 is driven by the transistor TR2. The transistor TR2 forms a source follower with the gate thereof set at the signal level of the signal line SIG. Here, Vcat represents a cathode voltage of the organic EL element 8. The drive pulse signal DS is a timing signal controlling an emission period of each pixel 23. The drive scan circuit (DSCN) 24B generates the drive pulse signal DS by successively transferring predetermined sampling pulses.

The two terminals of the signal level maintaining capacitor C1 are connected to predetermined fixed voltages Vofs and Vss via transistors TR4 and TR5 that are turned on and off in response to control signals AZ1 and AZ2, respectively. The control signal generators 24C and 24D in a vertical driver circuit 24 generate control signals AZ1 and AZ2 as timing signals by successively transferring predetermined sampling pulses.

FIG. 20 is a timing diagram of one pixel 23 in the display device 21. FIG. 20 also shows reference symbols of transistors that are turned on and off in response to corresponding signals. As shown in FIG. 21, during an emission period T1 for causing the organic EL element 8 to emit light, transistors TR1, TR4 and TR5 in the pixel 23 are turned off in response to falling edges of the write signal WS and the control signals AZ1 and AZ2 (waveform diagrams (A)-(C) in FIG. 20). The transistors TR3 is turned on in response to a rising edge of the drive pulse signal DS (waveform diagram (D) of FIG. 20).

The transistor TR2 and the signal level maintaining capacitor C1 in the pixel 23 form a constant current circuit responding to the gate-source voltage Vgs, namely, a voltage difference between the two terminals of the signal level maintaining capacitor C1. The organic EL element 8 emits light in response to the drive current Ids determined by the gate-source voltage Vgs. Luminance drop of the organic EL element 8 due to aging is thus controlled. The drive current Ids is expressed by equation (1) discussed with reference to FIG. 16. In the discussion that follows, each transistor is shown in each figure as a reference symbol of a corresponding switch as appropriate.

The transistors TR4 and TR5 in the pixel 23 remains turned on during a period T2 in succession to the end of an emission period T1 as shown in FIG. 22. The two terminals of the signal level maintaining capacitor C1 in the pixel 23 are set to predetermined fixed voltages Vofs and Vss (waveform diagrams (E) and (F) of FIG. 20). The drive current Ids corresponding to the gate-source voltage Vgs, namely, a voltage difference Vofs-Vss of the predetermined fixed voltages Vofs and Vss flows from the transistor TR2 to the transistor TR5. The fixed voltages Vofs and Vss are set within the period T2 so that the organic EL element 8 may not emit light as a result of an increase of the voltage difference between the two terminals of the organic EL element 8 in excess of the voltage threshold value Tthe1 of the organic EL element 8 and so that the transistor TR2 operates in the saturation region thereof.

Throughout a predetermined period T3, the transistor TR5 in the pixel 23 remains turned off as shown in FIG. 23. As represented by a broken line in FIG. 23, the drain-source current Ids of the transistor TR2 in the pixel 23 causes the voltage at the terminal of the signal level maintaining capacitor C1 connected to the transistor TR5 to rise.

FIG. 24 illustrates an equivalent circuit of the organic EL element 8 as a parallel circuit of a diode and a capacitor having a capacitance of Ce1. The drain-source current Ids of the transistor TR2 causes a source voltage Vs of the transistor TR2 to rise gradually during the period T3 as shown in FIG. 25. In the pixel 23, the voltage difference between the two terminals of the signal level maintaining capacitor C1 is set to a threshold voltage value Vth of the transistor TR2 and the voltage at the terminal of the signal level maintaining capacitor C1 connected to the transistor TR5 is set to a voltage Vofs-Vth resulting from subtracting the threshold voltage value Vth of the transistor TR2 from the fixed voltage Vofs. In this condition, an anode voltage Ve1 of the organic EL element 8 is represented by Ve1=Vofs−Vth. The fixed voltage Vofs is set to result in condition Ve1≦Vcat+Vthe1 in the display device 21 so that the organic EL element 8 may not emit light during the period T3.

The transistors TR3 and TR4 in the pixel 23 are turned off one after another within a period T4 as shown in FIG. 26. With the transistor TR3 turned off prior to turning off the transistor TR4, variations in a gate voltage Vg of the transistor TR2 are controlled. The transistor TR1 in the pixel 23 is then turned off, causing the voltage at the terminal of the signal level maintaining capacitor C1 connected to the transistor TR5 to a signal level Vsig of the signal line SIG when the voltage at the terminal of the signal level maintaining capacitor C1 connected to the transistor TR5 is at the voltage Vofs−Vth.

The gate-source voltage Vgs of the transistor TR2 is expressed in equation (2):

$$Vgs=Ce1/(Ce1+C1+C2)\times(Vsig-Vofs)+Vth \quad (2)$$

where C2 represents a gate-source capacitance of the transistor TR2. If a parasitic capacitance Ce1 of the organic EL element 8 is larger than each of a capacitance of the signal level maintaining capacitor C1 and a gate-source capacitance C2 of the transistor TR2, the gate-source voltage Vgs of the transistor TR2 is set to a voltage (Vsig+Vth) at a practically high accuracy level.

The gate-source voltage Vgs of the transistor TR2 in the pixel 23 is thus set to the voltage (Vsig+Vth) that is obtained by adding the threshold voltage value Vth to the signal level Vsig of the signal line SIG. The display device 21 thus controls variations in the emission luminance that is caused by variations, as one of the characteristics of the transistor TR2, in the threshold voltage value Vth.

The transistor TR3 is turned on with the transistor TR1 remaining on within a constant period T5 as shown in FIG. 27. The transistor TR2 in the pixel 23 allows the drain-source current Ids to flow out in response to the gate-source voltage Vgs corresponding to the voltage difference across the two terminals of the signal level maintaining capacitor C1. If the source voltage Vs of the transistor TR2 is lower than the sum of the threshold voltage value Vthe1 and the cathode voltage Vcat of the organic EL element 8 and a current flowing into the organic EL element 8 is small, the source voltage Vs of the transistor TR2 gradually rises from a voltage Vs0 in response to the drain-source current Ids of the transistor TR2 as shown in FIG. 38. The voltage Vs0 is calculated from the following equation (3):

$$Vs0=Vofs-Vth+(C1+C2)/(Ce1+C1+C2)\times(Vsig-Vofs) \quad (3)$$

The rising rate of the source voltage Vs depends on a mobility μ of the transistor TR2. The reference symbols Vs1 and Vs2 represent respectively the source voltages for high and low mobilities μ. The higher the mobility, the higher the rising rate of the source voltage Vs results.

The transistor TR3 in the pixel 23 is turned on with transistor TR1 left on during the constant period T5. Variations in the emission luminance due to variations in the mobility, as one of the characteristics of the transistor TR2, are thus controlled.

With the transistor TR1 turned off as shown in FIG. 21, the organic EL element 8 is driven by the gate-source voltage Vgs set with the voltage threshold value Vth and the mobility μ corrected. With the transistor TR1 off, the source voltage Vs of the transistor TR2 rises to a voltage level that permits the drain-source current Ids of the transistor TR2 flows into the organic EL element 8. The organic EL element 8 thus emits light and the gate voltage Vg of the transistor TR2 also rises.

The circuit arrangement of FIG. 19 reduces a drop in the emission luminance of the organic EL element 8 as a result of aging and controls variations in the emission luminance due to variations in the characteristics of the transistor TR2.

For each pixel 23, the circuit arrangement of FIG. 19 includes a single signal line SIG, four scanning lines of the control signals AZ1 and AZ2, the drive pulse signal DS and the write signal WS and four wiring pattern lines of pixel voltages Vcc, Vofs, Vss and Vcat. Even if scanning lines are commonly shared by red color, blue color and green color and the cathode voltage Vcat is arranged separately, 3×3 wiring pattern lines are required for a set of a red pixel, a blue pixel and a green pixel.

The display device employing the N-channel transistors has the problem of too many wiring pattern lines for fixed voltages. Many wiring pattern lines for the fixed voltage present difficulty efficiently arranging pixels at a high density. It becomes difficult to manufacture high-definition display devices at a high yield.

SUMMARY OF THE INVENTION

It is thus desirable to provide a display device having a smaller number of wiring pattern lines for fixed voltages.

In accordance with one embodiment of the present invention, a display device includes a pixel section of a matrix of pixels and a driver circuit for driving the pixel circuit. Each pixel includes a signal level maintaining capacitor, a first transistor, turned on and off in response to a write signal, for connecting one terminal of the signal level maintaining capacitor to a signal line, a second transistor having a gate thereof connected to the one terminal of the signal level maintaining capacitor and a source thereof connected to the other terminal of the signal level maintaining capacitor, a current-driven self-luminous element with a cathode thereof held at a cathode voltage and an anode thereof connected to the source of the second transistor, a third transistor, turned on and off in response to a drive pulse signal, for connecting a drain of the second transistor to a power source voltage, an a fourth transistor connected to the other terminal of the signal level maintaining capacitor. The fourth transistor receives the drive pulse signal at the source thereof with the drain thereof connected to the other terminal of the signal level maintaining capacitor. When turned on in response to a control signal applied to the gate thereof, the fourth transistor sets the other terminal of the signal level maintaining capacitor to a signal level of the drive pulse signal.

The other terminal of the signal level maintaining capacitor is set to a predetermined voltage level, namely, the signal level of the drive pulse signal. The wiring pattern lines for the predetermined voltages are thus eliminated, and the number of wiring pattern lines for the fixed voltages is reduced.

DESCRIPTION OF THE PREFERRED EMBODIMENTS

The embodiments of the present invention are described below with reference to the drawings.

Figure 1:
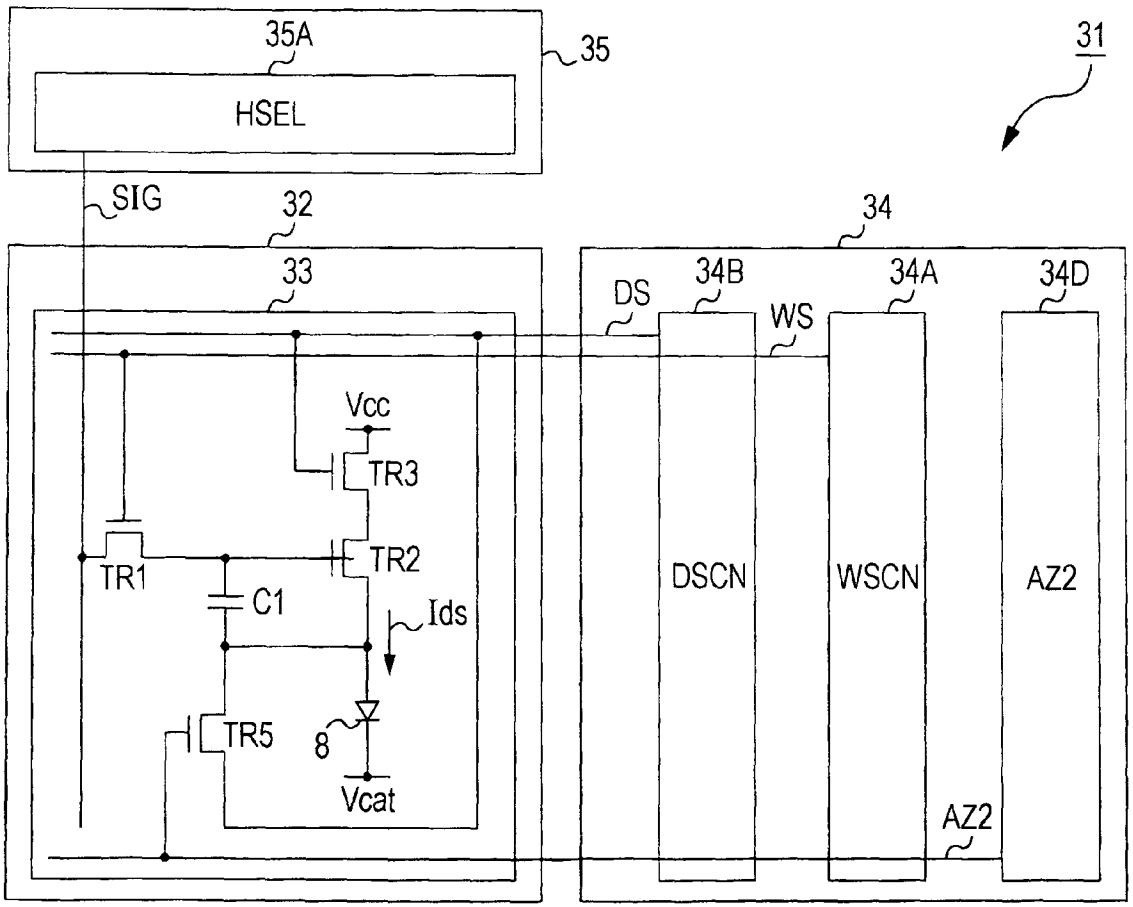
FIG. 1 is a block diagram of a display device in accordance with one embodiment of the present invention.
Figure 15:
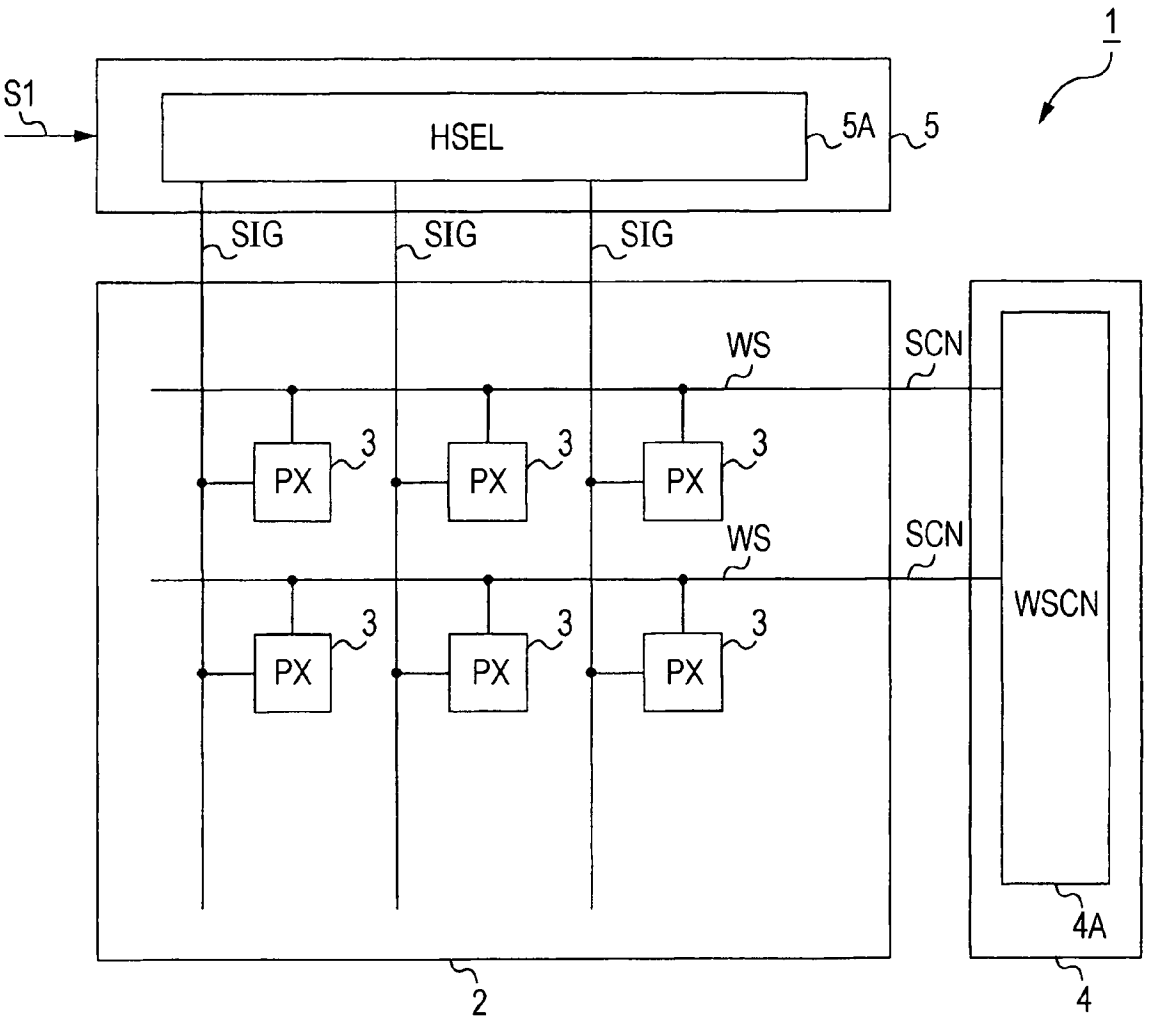
RELATED ART FIG. 15
FIG. 15 is a block diagram illustrating a display device of related art.
Figure 16:
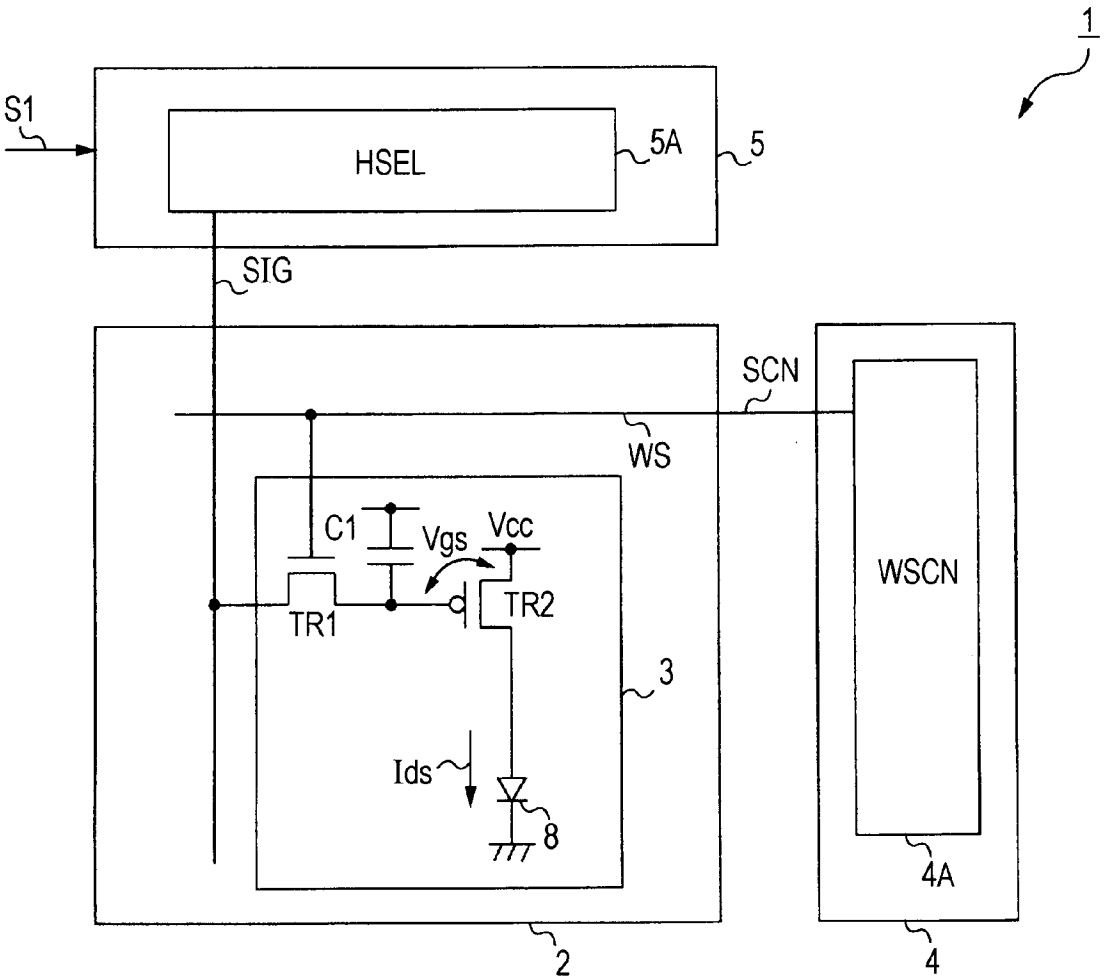
FIG. 16 is a block diagram illustrating in detail the display device of FIG. 15.
Figure 17:
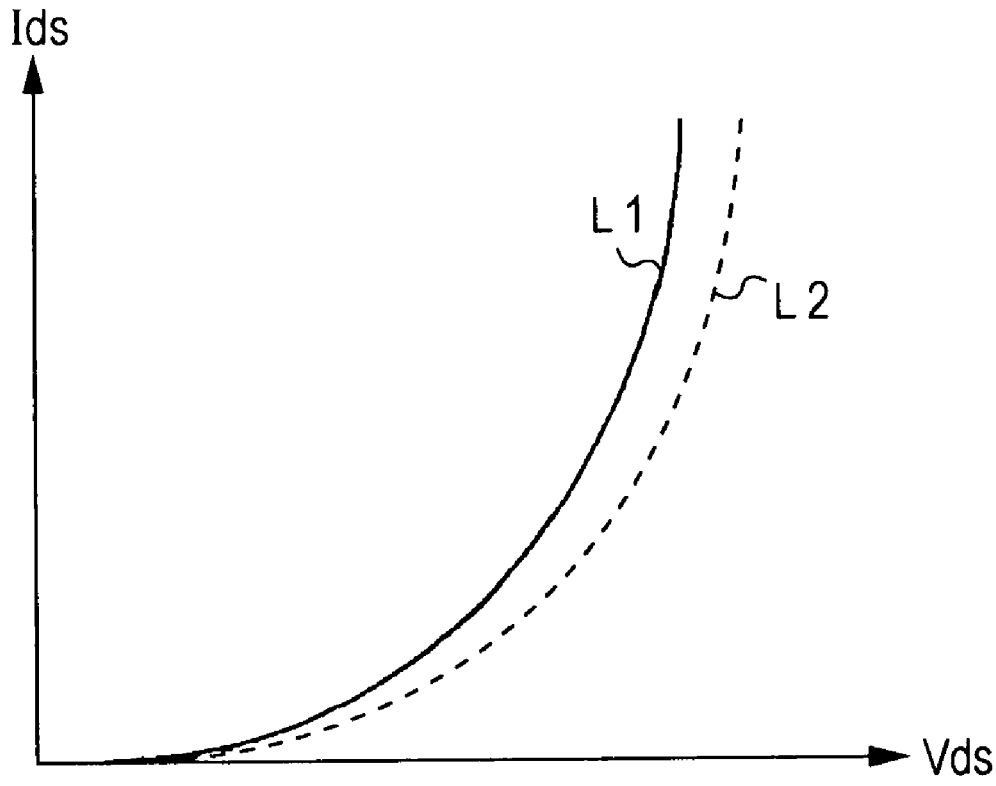
FIG. 17 illustrates a characteristic curve representing an organic EL element aged with time.
Figure 18:
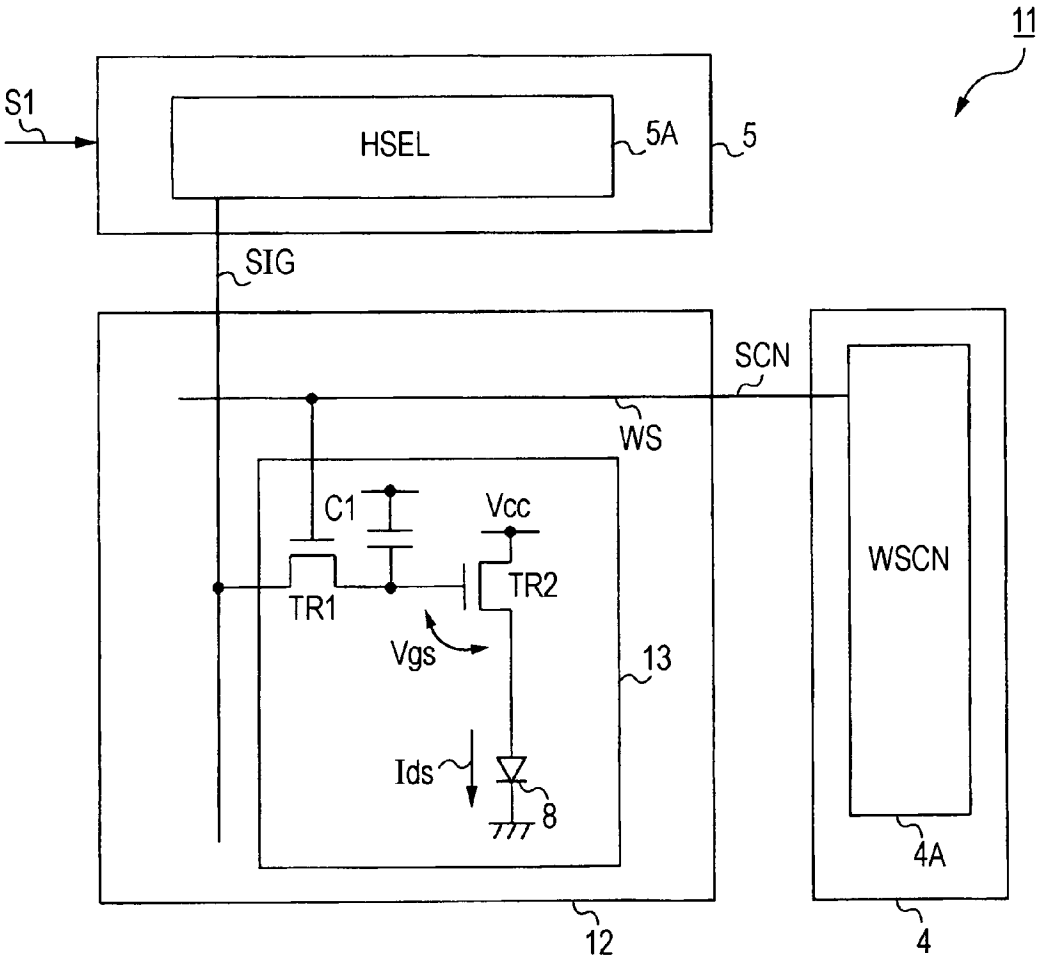
FIG. 18 is a block diagram illustrating the display device of FIG. 15 employing N-channel transistors.
Figure 19:
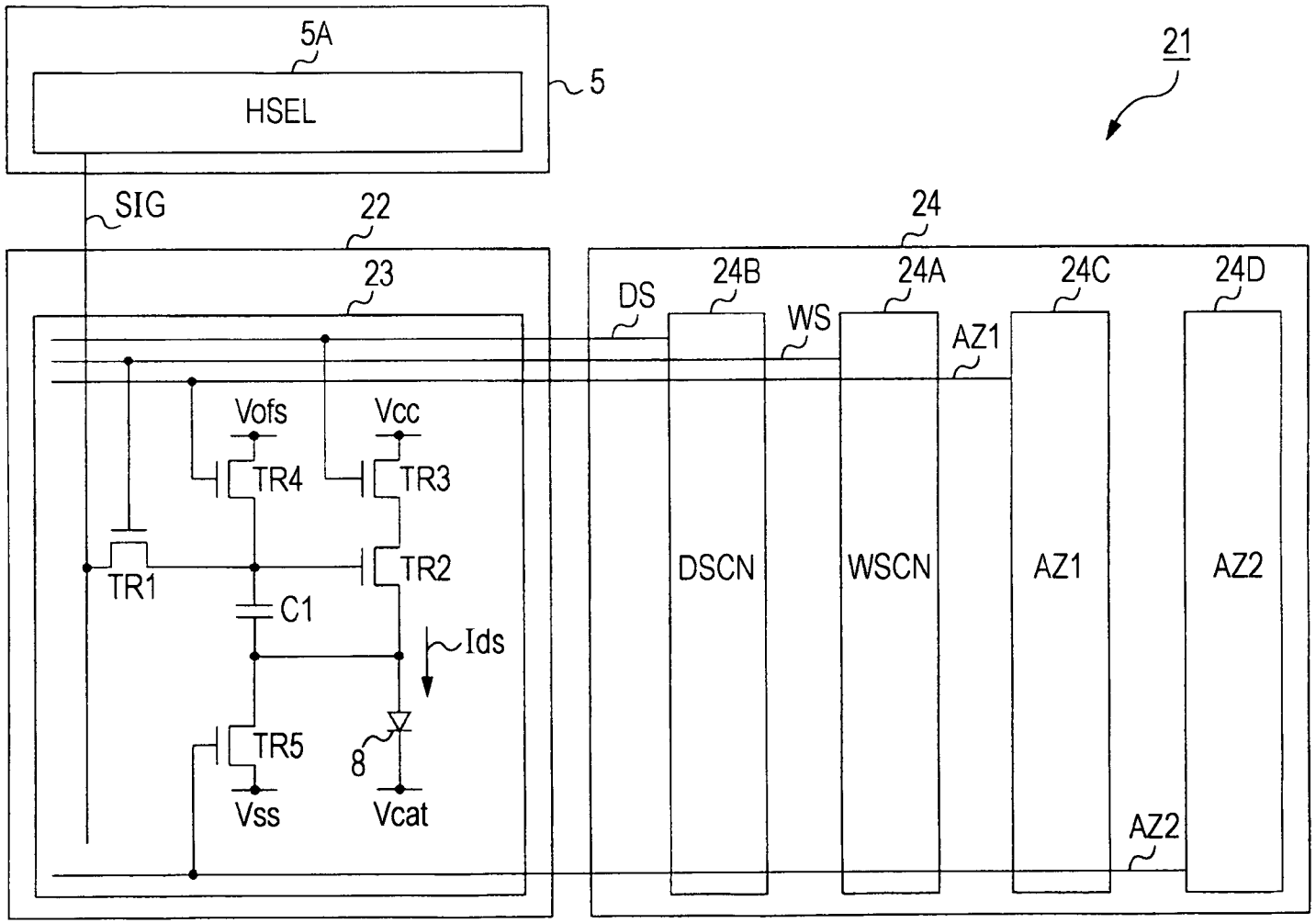
FIG. 19 is a block diagram illustrating a display device of related art employing N-channel transistors.

FIG. 1, in comparison with FIG. 19, is a block diagram illustrating a display device 31 in accordance with a first embodiment of the present invention. In FIG. 1, elements described in comparison with the display devices 1, 11 and 21 illustrated with reference to FIGS. 15 and 19 are designated with the same reference numerals and the discussion thereof is omitted herein. The display device 31 is fabricated of N-channel transistors. A pixel section 32, a vertical driver circuit 34 and a horizontal driver circuit 35 in the display device 31 are integrally formed on a glass substrate as an insulating transparent substrate using an amorphous silicon process.

Figure 2:
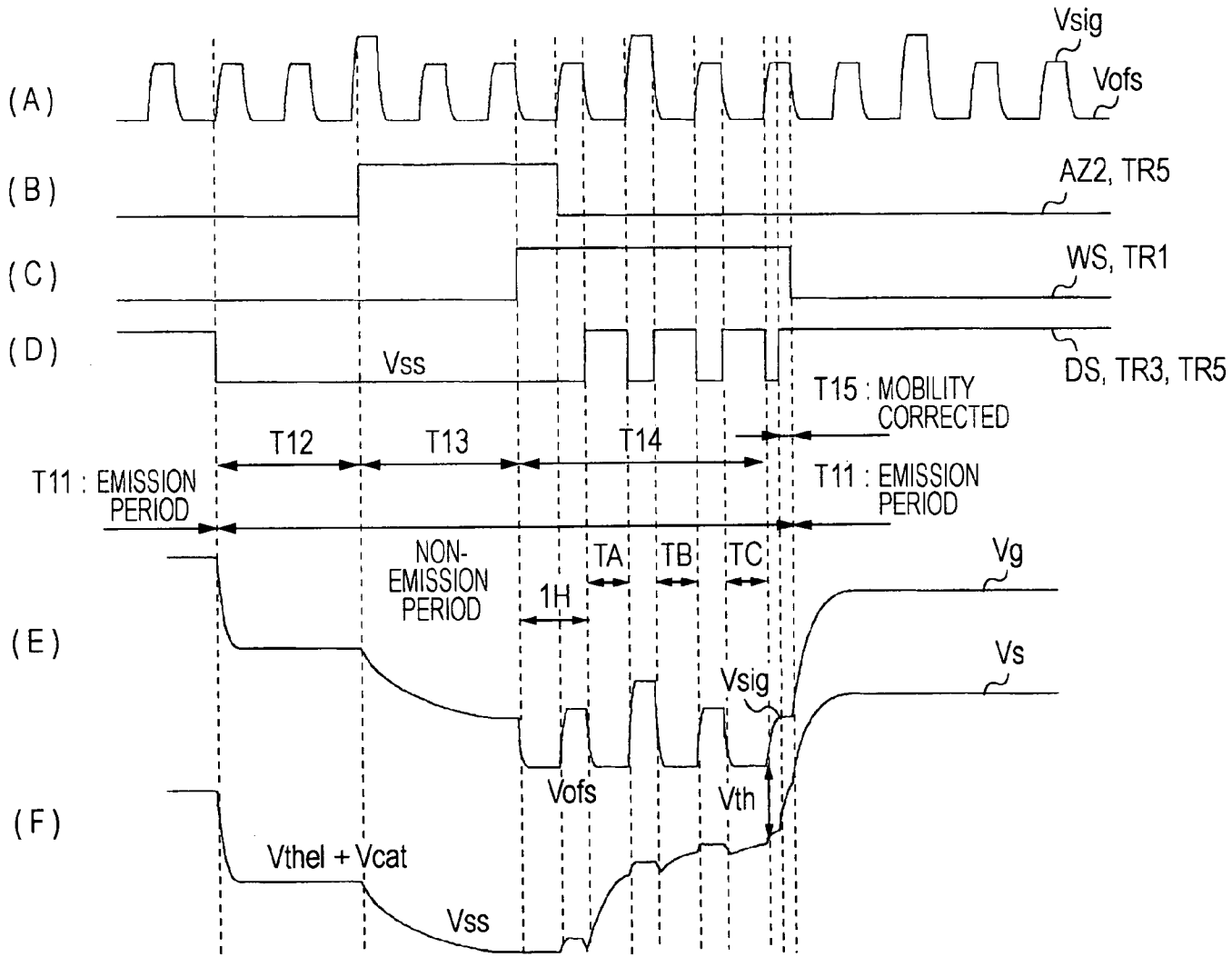
FIG. 2 is a timing diagram of the display device of FIG. 1.
Figure 20:
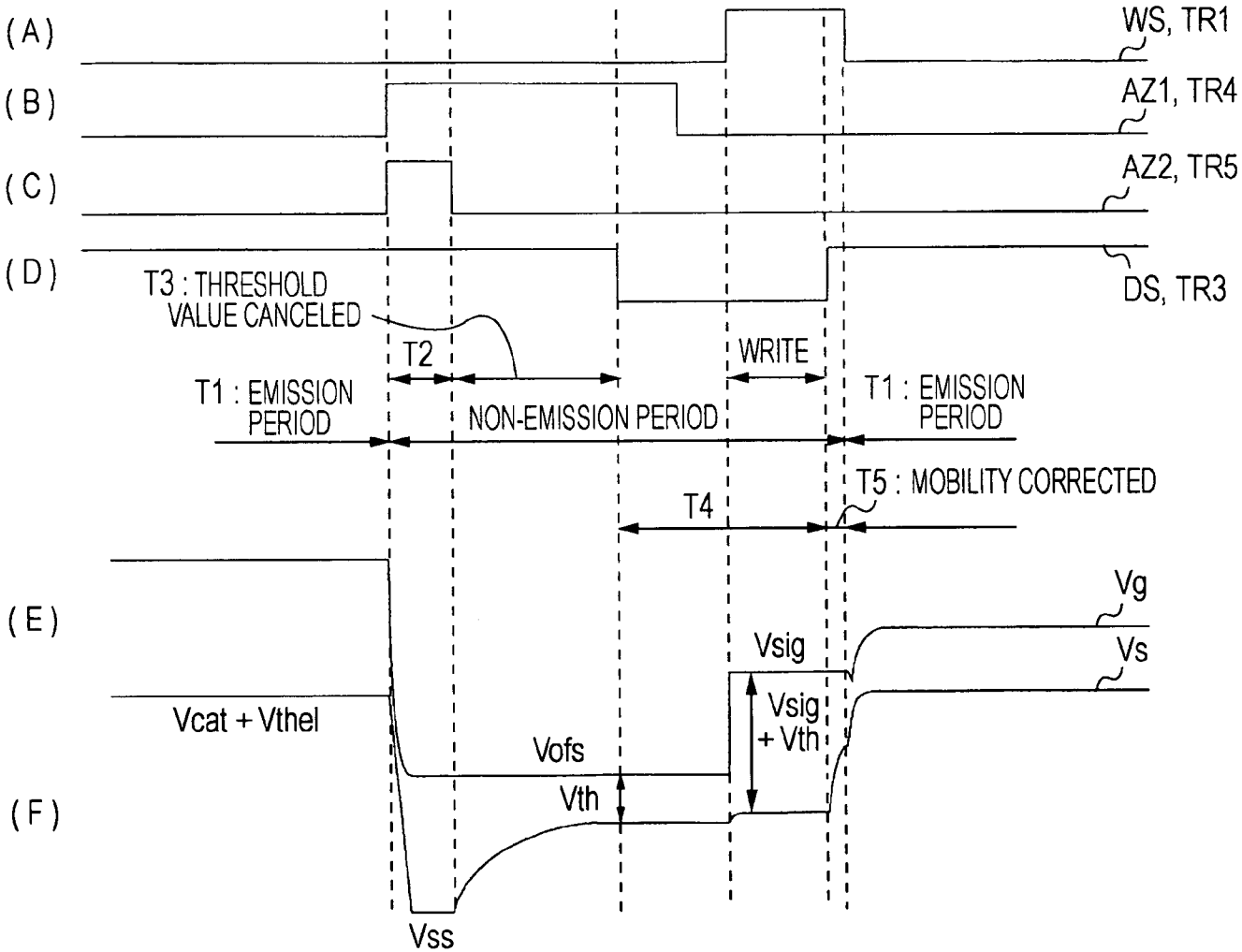
FIG. 20 is a timing diagram of the display device of FIG. 19.
Figure 21:
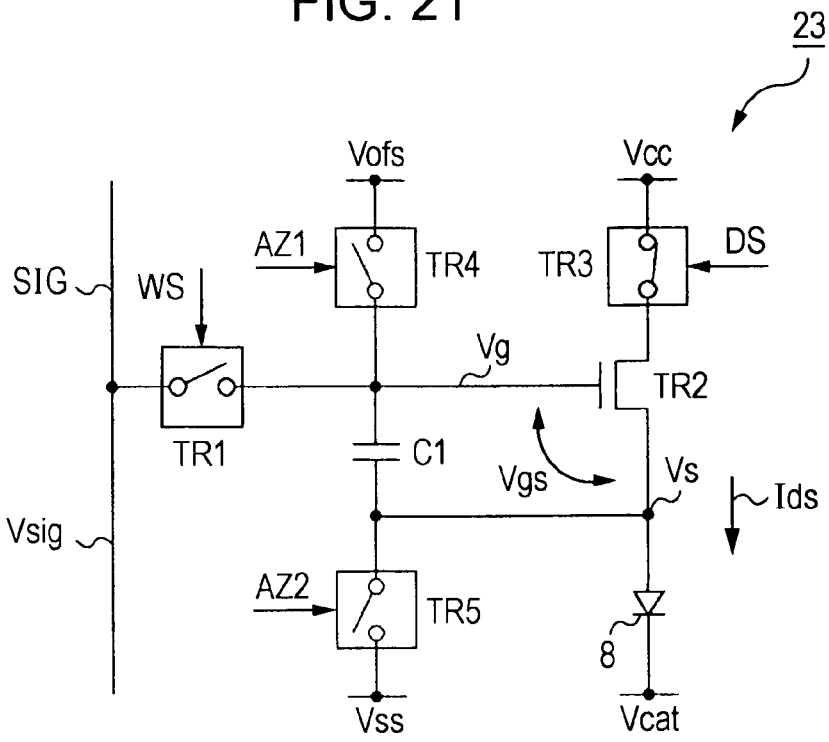
FIG. 21 is a schematic diagram illustrating a setting of a pixel during a period T1 of FIG. 20.
Figure 22:
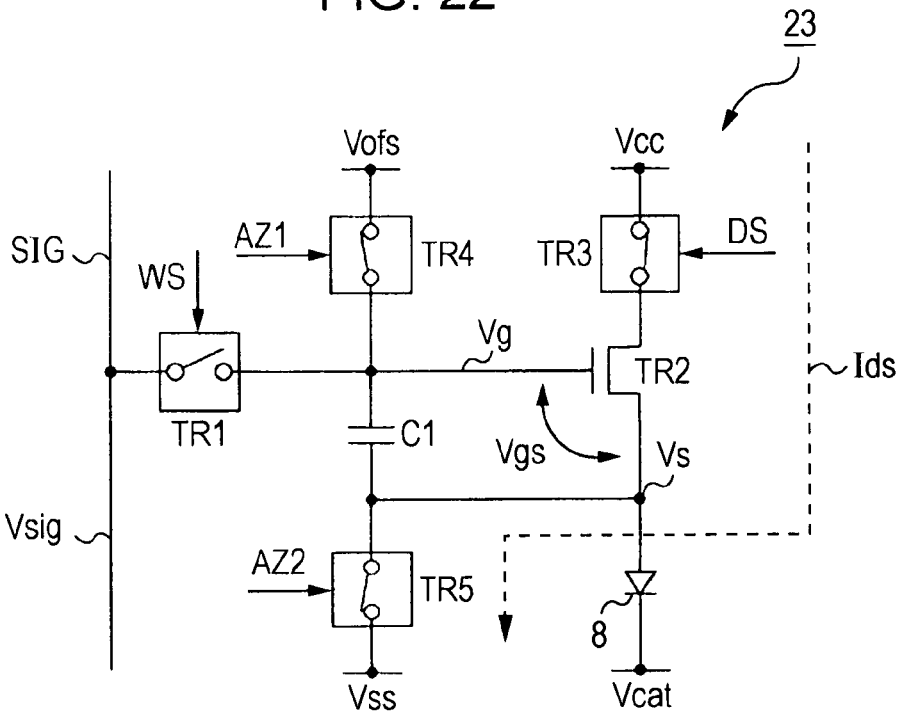
FIG. 22 is a schematic diagram illustrating a setting of the pixel during a period T2 of FIG. 20.
Figure 23:
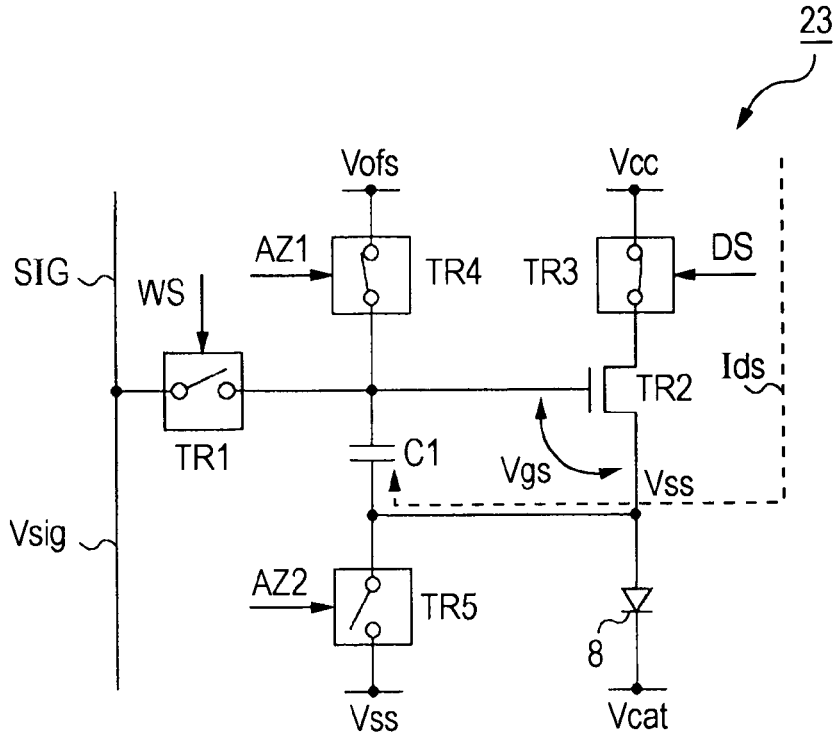
FIG. 23 is a schematic diagram illustrating a setting of the pixel during a period T3 of FIG. 20.
Figure 24:
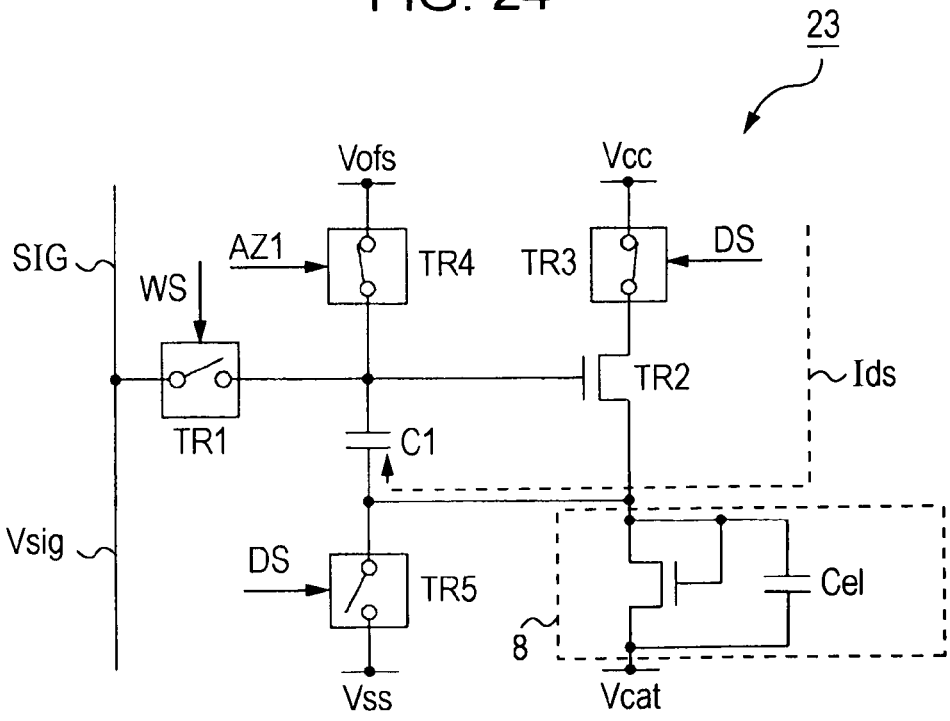
FIG. 24 is a schematic diagram illustrating a setting of the pixel performed in succession to the setting of FIG. 32.
Figure 25:
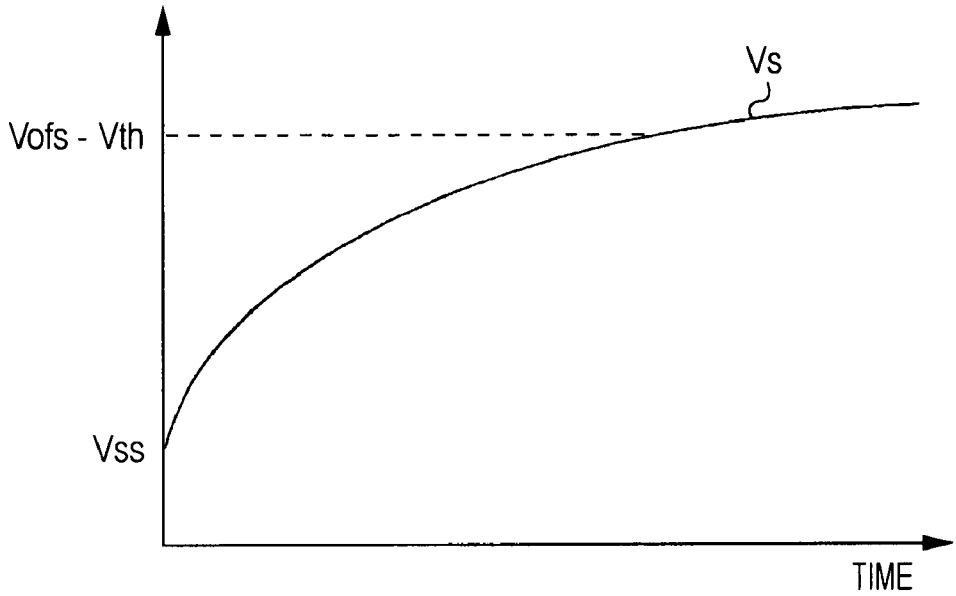
FIG. 25 illustrates a characteristic curve related correction of a threshold voltage.
Figure 26:
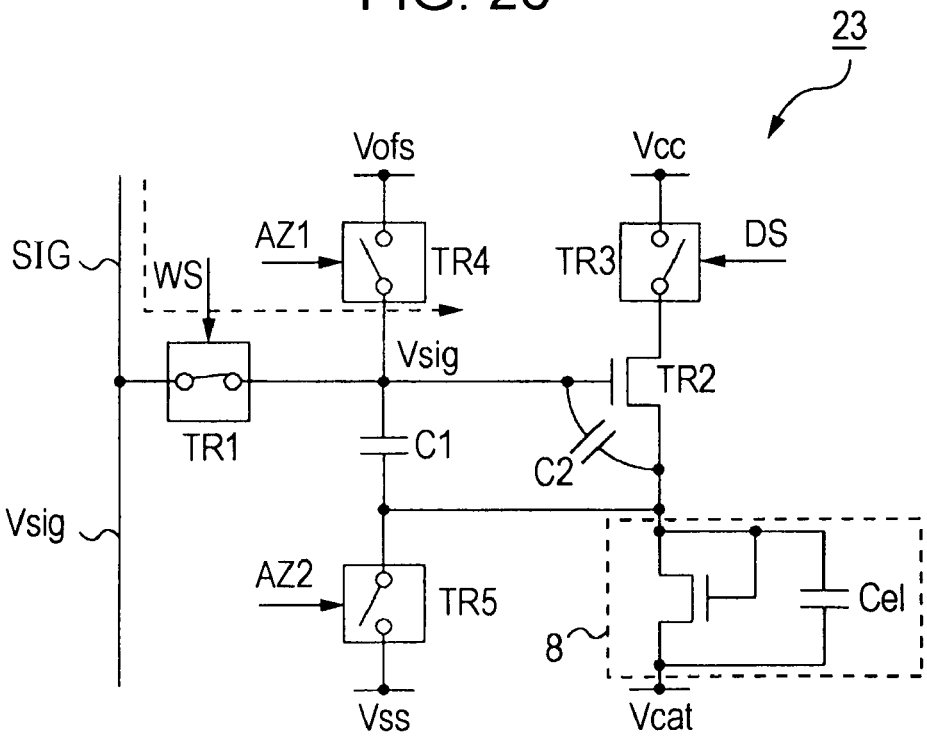
FIG. 26 is a schematic diagram illustrating a setting of the pixel during a period T4 of FIG. 20.
Figure 27:
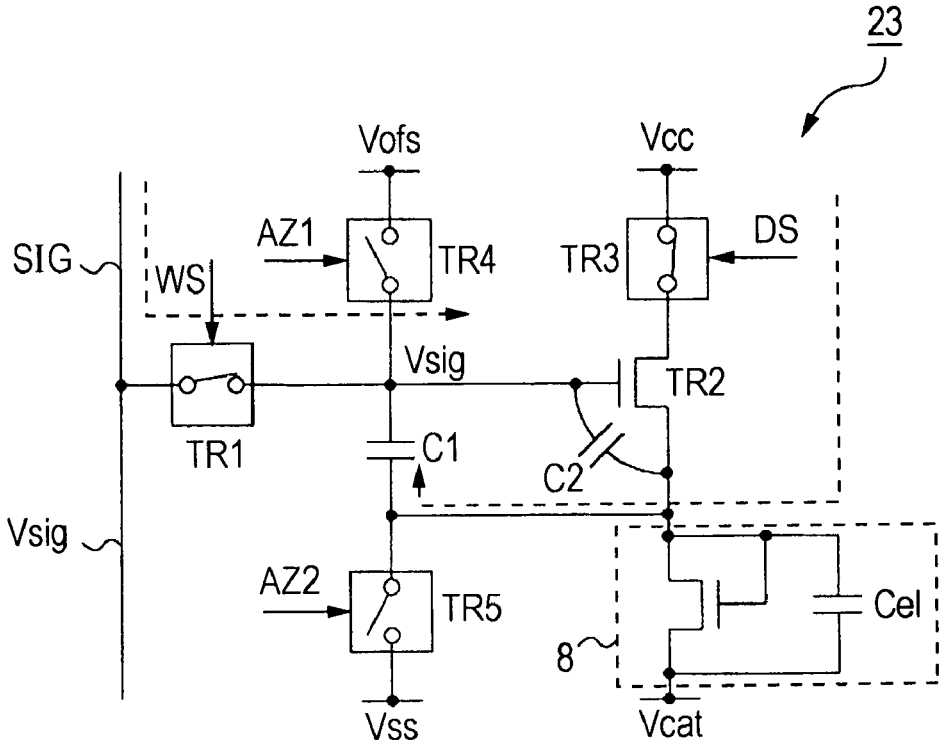
FIG. 27 is a schematic diagram illustrating a setting of the pixel during a period T5 of FIG. 20.
Figure 28:
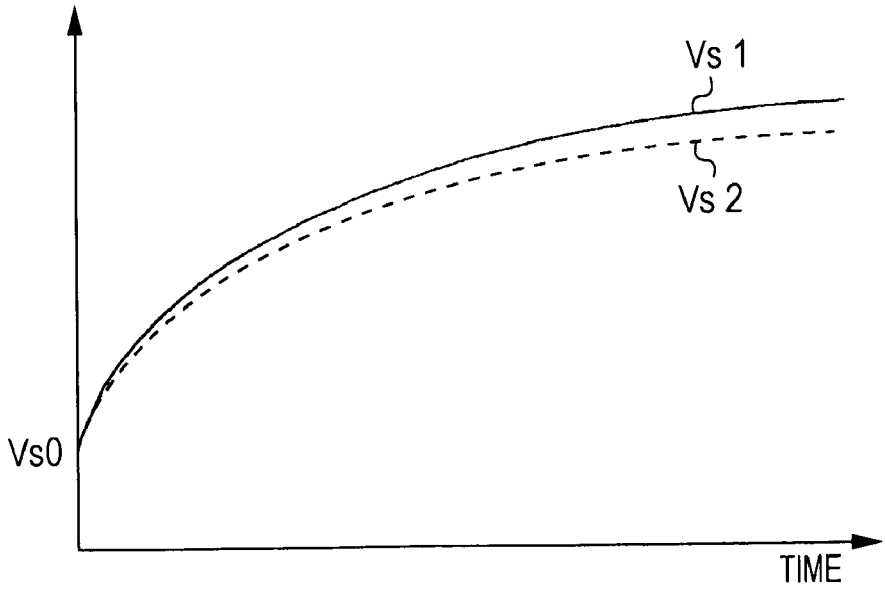
FIG. 28 illustrates a characteristic curve related to correction of a mobility.

A horizontal selector (HSEL) 35A in the horizontal driver circuit 35 generates a timing signal by transferring successively predetermined sampling pulses and sets each signal line SIG to a signal level of an input signal S1 with respect to the timing signal. As shown in FIG. 2, provided in comparison with FIG. 20, the signal level of the signal line SIG is set to a predetermined fixed voltage Vofs at the pixel 23 discussed with reference to FIG. 19 for about a first half of one horizontal scanning period (1H) and then set to a signal level Vsig responsive to a gradation of a pixel 34 corresponding to the signal level of the signal line SIG for a subsequent second half of the one horizontal scanning period (waveform diagram (A) of FIG. 2). As shown in FIG. 2, each signal is labeled a reference symbol of each transistor that is turned on and off in response to the corresponding signal.

The vertical driver circuit 34, as opposed to the horizontal driver circuit 35, does not include a control signal generator circuit (AZ1) outputting the control signal controlling the fixed voltage Vofs. A write scan circuit (WSCN) 34A, a drive scan circuit (DSCN) 34B and a control signal generator 34D in the vertical driver circuit 34 generate respectively a write signal WS, a drive pulse signal DS and a control signal AZ2. The drive pulse signal DS is generated in order to turn on and off the transistor TR3. The drive pulse signal DS, when transitioned to a lower level, becomes a fixed voltage Vss discussed with reference to FIG. 19 (waveform diagram (D) of FIG. 2).

A matrix of pixels 33 is formed in the pixel section 22. In the pixel 33, one terminal of the signal level maintaining capacitor C1 is connected to the anode of an organic EL element 8 and the other terminal of the signal level maintaining capacitor C1 is connected to the signal line SIG via the transistor TR1 that is turned on and off in response to the write signal WS. The voltage of the other terminal of the signal level maintaining capacitor C1 in the pixel 33 is thus set to the signal level of the signal line SIG in response to the write signal WS.

The two terminals of the signal level maintaining capacitor C1 are respectively connected to the source and the gate of the transistor TR2 in the pixel 33. The drain of the transistor TR2 is connected to the power source Vcc via a transistor TR3 that is turned on and off in response to the drive pulse signal DS. The transistor TR2 having a source follower circuit arrangement with a gate voltage thereof set to the signal level of the signal line SIG in the pixel 33 thus drives the organic EL element 8.

The terminal of the signal level maintaining capacitor C1 connected to the organic EL element 8 in the pixel 33 is connected to drive pulse signal DS via a transistor TR5 that is turned on and off in response to a control signal AZ2. The transistor TR5 in the pixel 33 receives the drive pulse signal DS at the source thereof and the control signal AZ2 at the gate thereof. The drain of the transistor TR5 is connected to the terminal of the signal level maintaining capacitor C1 connected to the organic EL element 8. The drive pulse signal DS, when transitioned to a lower voltage level, becomes a fixed voltage Vss. If the transistor TR5 is turned on with the drive pulse signal DS at the lower voltage level thereof in the pixel 33, the drain voltage of the transistor TR5 is fixed to the fixed voltage Vss in the same manner as described with reference to FIG. 19. In this way, the wiring pattern for the fixed voltage Vss is eliminated in the pixel 33 as opposed to the display device 21 of FIG. 19. The number of wiring pattern lines for the fixed voltages is thus reduced.

Figure 3:
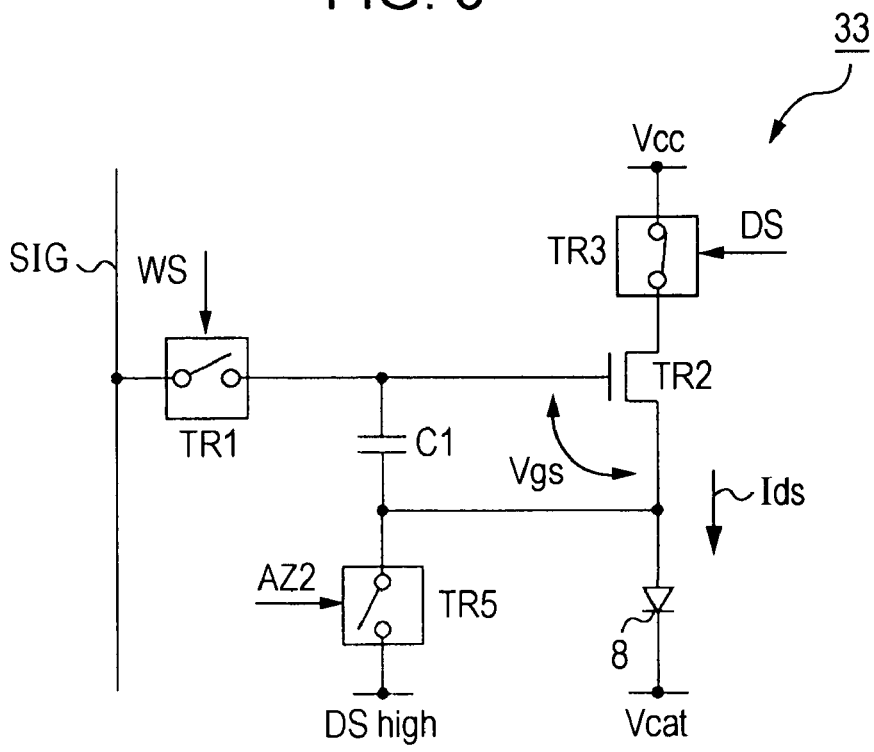
FIG. 3 is a schematic diagram illustrating the setting of a pixel during a period T11 of FIG. 2.

As shown in FIG. 3, the transistors TR1 and TR5 in the pixel 33 are turned off when the write signal WS and the control signal AZ2 are transitioned to the lower voltage levels thereof in the pixel 33 (waveform diagrams (B) and (C) of FIG. 2) during an emission period T11 for the organic EL element 8. The transistor TR3 is turned on when the drive pulse signal DS is transitioned to the lower voltage level thereof. The pixel 33 is thus designed so that the transistor TR2 operates in an saturation region thereof.

A constant current circuit responsive to the gate-source voltage Vgs caused by the voltage difference between the two terminals of the signal level maintaining capacitor C1 is formed of the transistor TR2 and the signal level maintaining capacitor C1 in the pixel 33. A drain-source current Ids determined by the gate-source voltage Vgs causes the organic EL element 8 to emit light. In this way, the display device 31 reduces a drop in the emission luminance of the organic EL element 8. The drain-source current Ids is expressed by equation (1).

Figure 4:
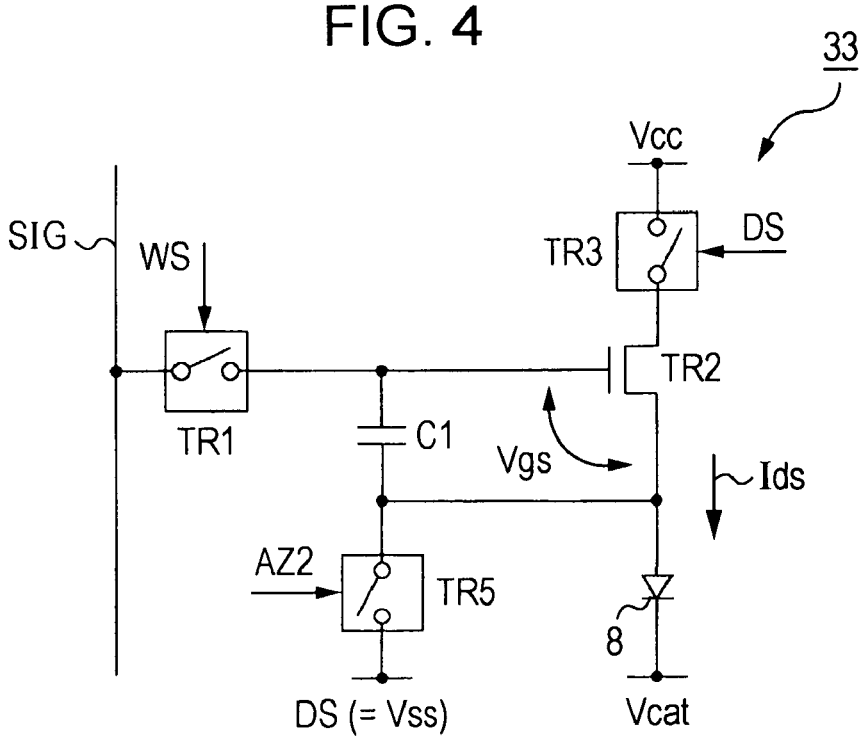
FIG. 4 is a schematic diagram illustrating the setting of a pixel during a period T12 of FIG. 2.

When the emission period T11 ends in the pixel 33, the drive pulse signal DS is transitioned to the fixed voltage Vss at the lower voltage level thereof within a constant period T12. As shown in FIG. 4, the transistor TR3 is turned off. During the constant period T12, the organic EL element 8 stops emitting light with the power source Vcc to the transistor TR2 cut off. The source voltage Vs of the transistor TR2 is set to a voltage (Vcat+Vthe1) that is obtained by adding a threshold voltage value Vthe1 of the organic EL element 8 to a cathode voltage Vcat of the organic EL element 8.

Figure 5:
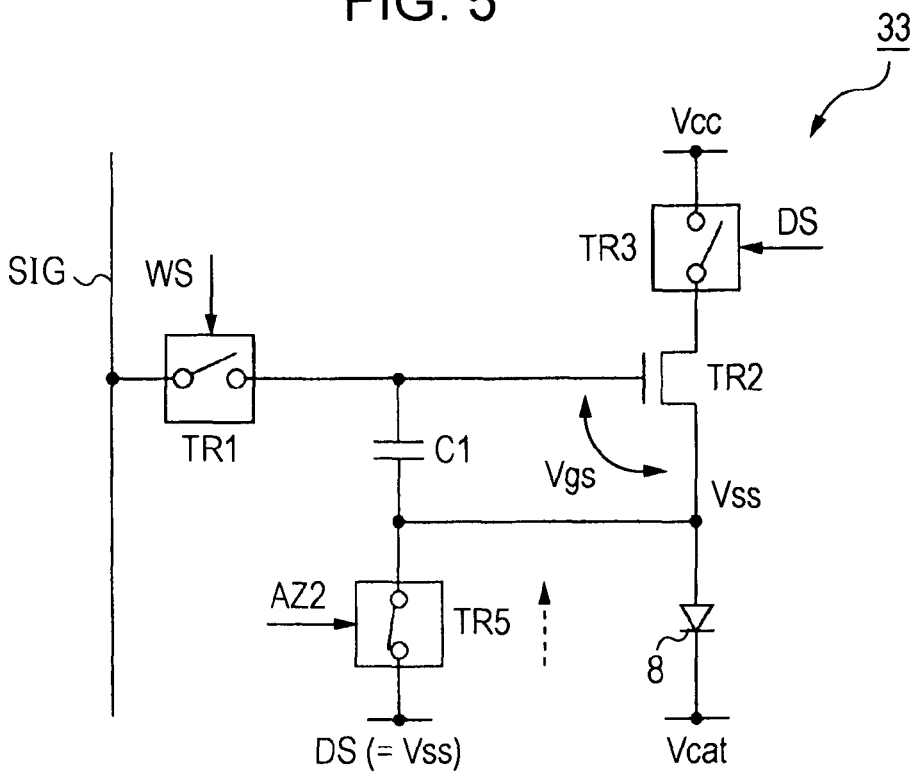
FIG. 5 is a schematic diagram illustrating the setting of a pixel during a period T13 of FIG. 2.

The control signal AZ2 in the pixel 33 remains at a high voltage state throughout a period T13 and the transistor TR5 remains turned on as shown in FIG. 5. The voltage at the terminal of the signal level maintaining capacitor C1 connected to the horizontal driver circuit 5 is set to the fixed voltage Vss of the drive pulse signal DS in the pixel 33. The fixed voltage Vss is set so that a relationship Vss≦Vthe1+Vcat holds between the cathode voltage Vcat of the organic EL element 8 and the threshold voltage value Vthe1 of the organic EL element 8. The organic EL element 8 stops emitting light during the period T13.

Figure 6:
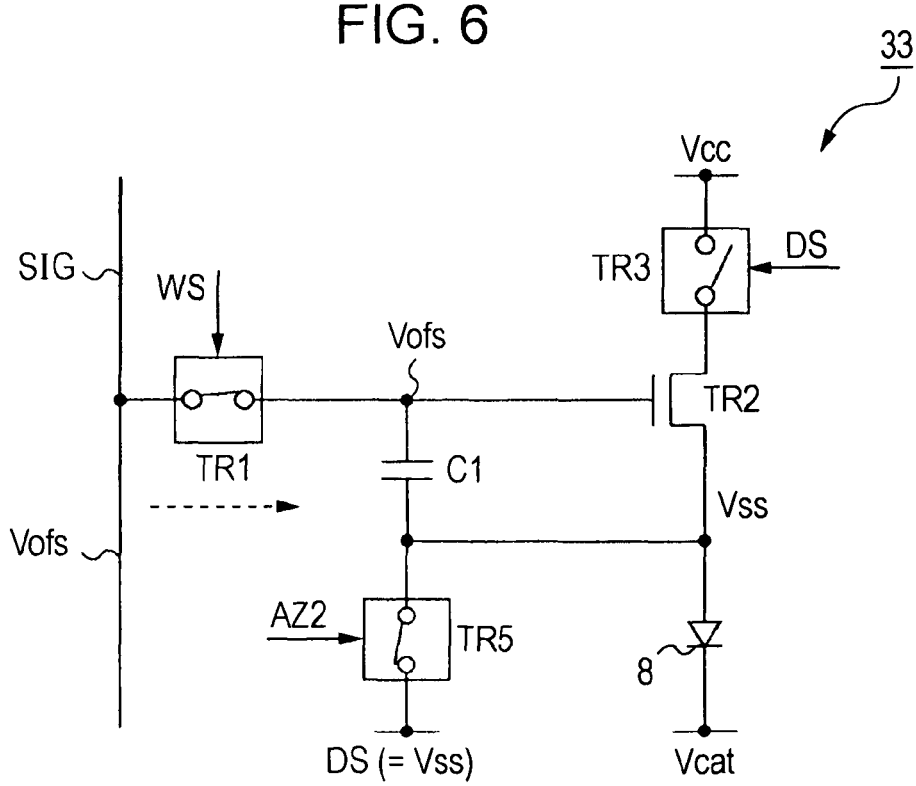
FIG. 6 is a schematic diagram illustrating the setting of a pixel during a period T14 of FIG. 2.

During a subsequent period T14, the write signal WS rises to the high level thereof with the signal level of the signal line SIG set at the fixed voltage Vofs and the transistor TR1 is turned on as shown in FIG. 6. In the pixel 33, the terminal of the signal level maintaining capacitor C1 connected to the transistor TR2 is thus set to the fixed voltage Vofs as the signal level of the signal line SIG.

Figure 7:
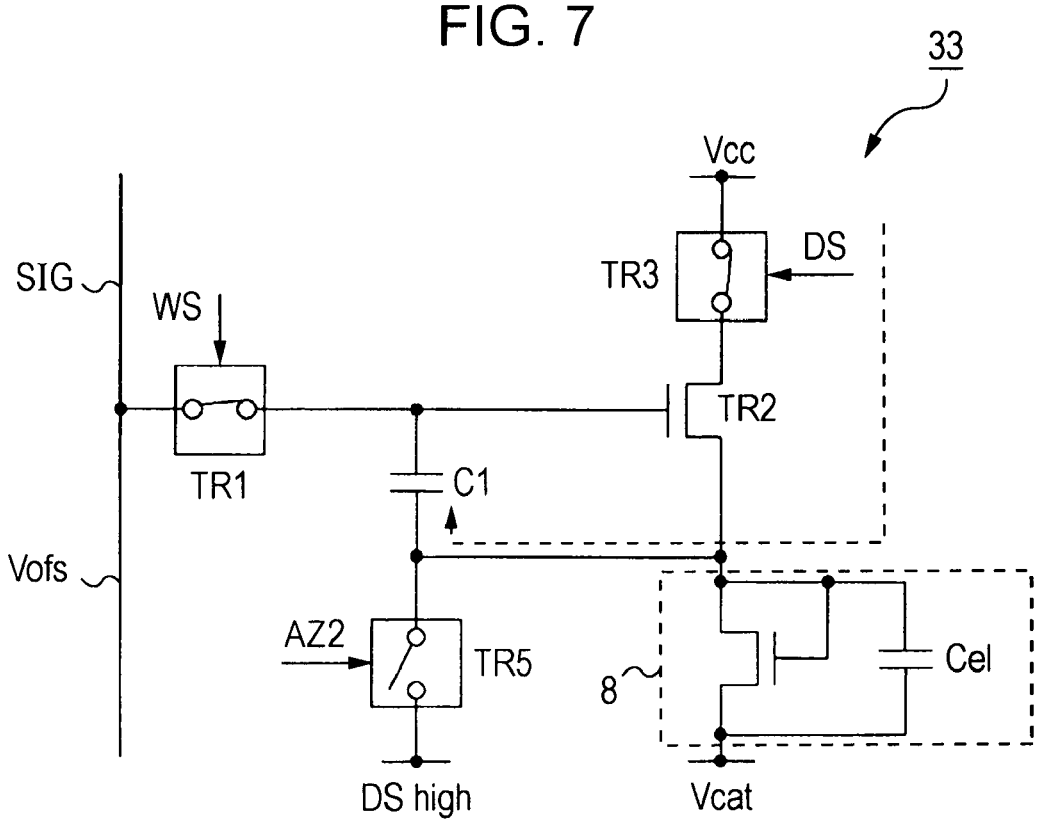
FIG. 7 is a schematic diagram illustrating the setting of the pixel performed in succession to the setting of FIG. 6.

The control signal AZ2 falls to the lower voltage level thereof, causing the transistor TR5 to turn off. The drive pulse signal DS rises at the timing of the signal level of the signal line SIG starting the fixed voltage Vofs, at a time point preceding the start of the emission period T11 by a predetermined number of scanning periods. As shown in FIG. 7, the transistor TR3 is turned on. The source voltage Vs of the transistor TR2 gradually rises in the direction that the voltage difference between the two terminals of the signal level maintaining capacitor C1 becomes the threshold voltage Vth of the transistor TR2.

As shown in FIG. 7, voltage Ve1≦Vact+Vthe1 is maintained in the pixel 33 so that a current substantially smaller than the drain-source current Ids of the transistor TR2 flows. The drain-source current Ids of the transistor TR2 is thus used to charge the signal level maintaining capacitor C1 and the capacitance of the organic EL element 8. The organic EL element 8 stops emitting light.

Figure 8:
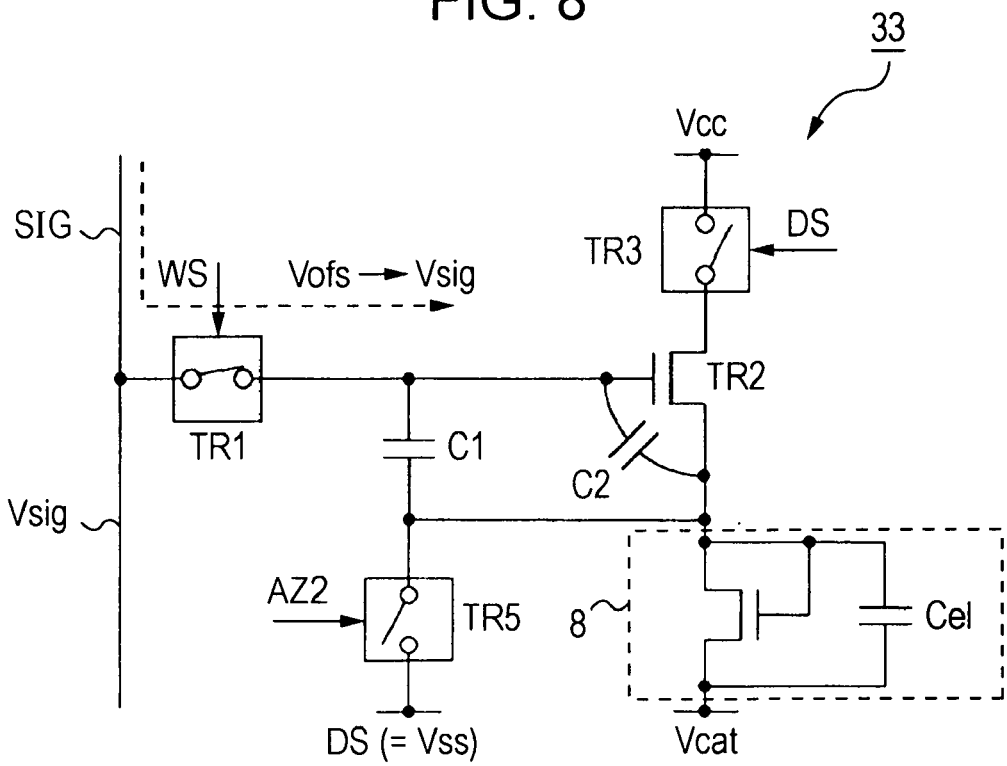
FIG. 8 is a schematic diagram illustrating the setting of the pixel performed in succession to the setting of FIG. 7.

The drive pulse signal DS rises to the high voltage level thereof at the timing the signal line SIG rises to the signal level Vsig corresponding to the pixel gradation. As shown in FIG. 8, the transistor TR3 is turned off. The relationship Ve1≦Vact+Vthe1 is maintained and the organic EL element 8 remains inactive, stopping emitting light. The change in the source voltage Vs of the transistor TR2 is expressed by equation (4):

$$\Delta Vs=(C1+C2)/(Ce1+C1+C2)\times(Vsig-Vofs) \quad (4)$$

After a predetermined period of time, the signal level of the signal line SIG is set to be the fixed voltage Vofs and input to the gate of the transistor TR2. A change in the source voltage Vs of the transistor TR2 is expressed by the following equation (5):

$$\Delta Vs=(C1+C2)/(Ce1+C1+C2)\times(Vofs-Vsig) \quad (5)$$

Figure 9:
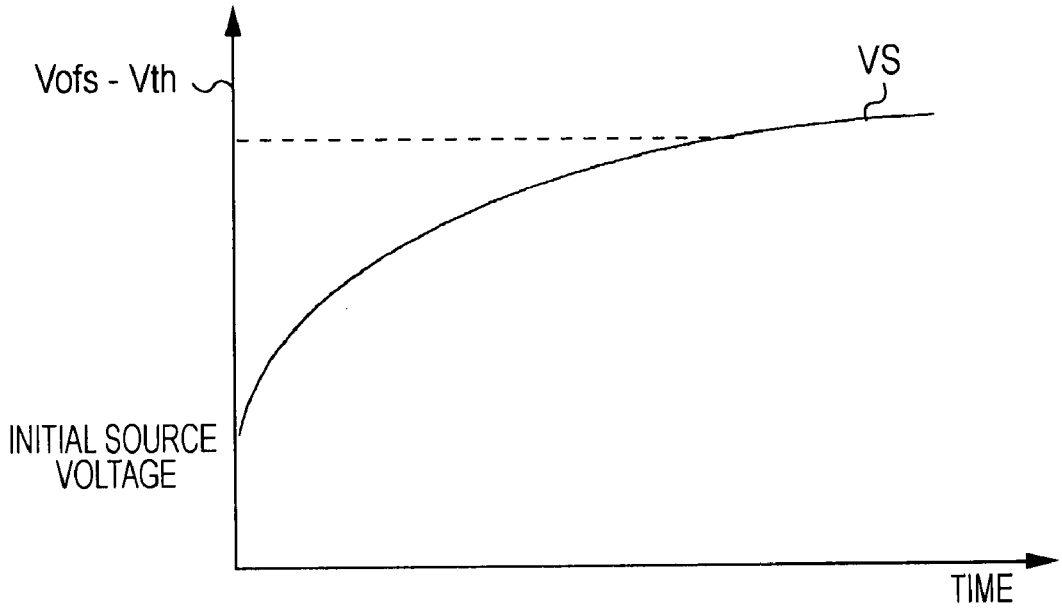
FIG. 9 illustrates a characteristic curve related to correction of a threshold voltage value.

The state that the drive pulse signal DS is at the high voltage level as shown in FIG. 7 and the state that the drive pulse signal DS is at the low voltage level as shown in FIG. 8 are repeated by a predetermined times in the pixel 33. The source voltage Vs of the transistor TR2 gradually rises to set the voltage difference between the two terminals of the signal level maintaining capacitor C1 to the threshold voltage Vth of the transistor TR2. As shown in FIG. 2, during periods TA, TB and TC, the voltage difference between the two terminals of the signal level maintaining capacitor C1 is set to the threshold voltage Vth of the transistor TR2. FIG. 9 illustrates a characteristic curve that shows a change in the source voltage Vs of the transistor TR2 with the signal level of the signal line SIG maintained at the fixed voltage Vofs for a long period of time. Finally, the gate-source voltage Vgs of the transistor TR2 becomes the voltage Vth. In this way, the display device 31 repeats the states of FIGS. 7 and 8 by a sufficient number of times to set the voltage difference between the two terminals of the signal level maintaining capacitor C1 to the threshold voltage Vth of the transistor TR2.

Figure 10:
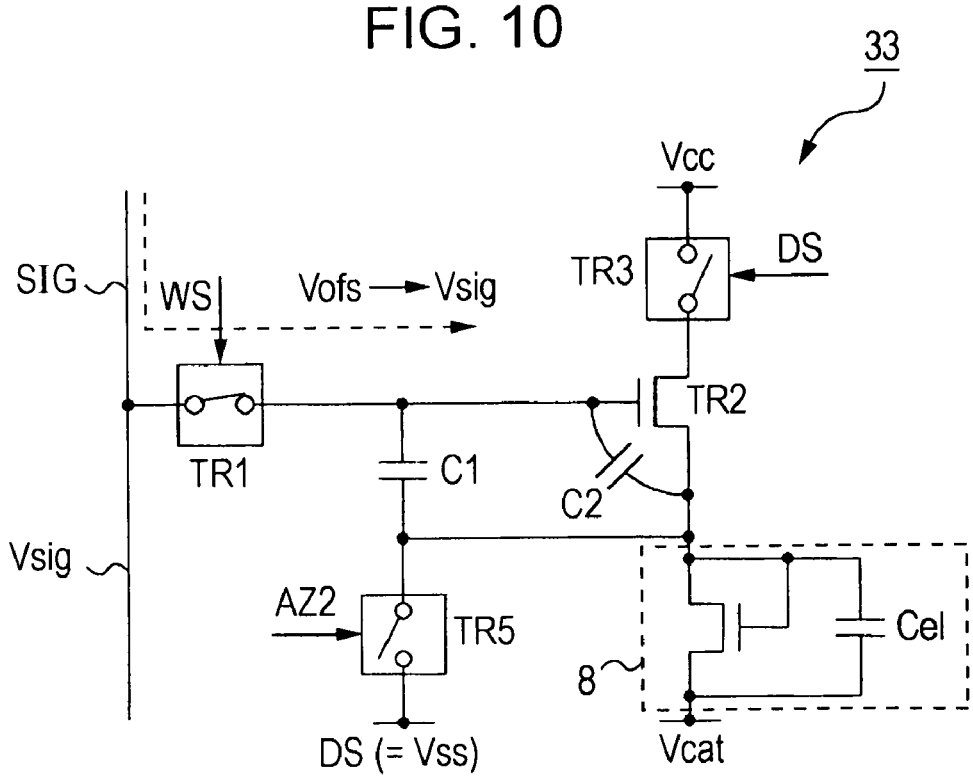
FIG. 10 is a schematic diagram illustrating a setting of the pixel during a period T15 of FIG. 2.

Within the period T14, the threshold voltage Vth of the transistor TR2 is set at the signal level maintaining capacitor C1 in the pixel 33. The drive pulse signal DS is transitioned to the low voltage level at the timing the signal level of the signal line SIG rises to the signal level Vsig of the corresponding pixel immediately prior to the start of the period T11. As shown in FIG. 10, the transistor TR3 is turned off.

The drive pulse signal DS is transitioned to the low voltage level thereof with the signal level of the signal line SIG set to the signal level of the corresponding pixel. The transistor TR1 is then turned off. The signal level of the signal line SIG is sample-held to the signal level maintaining capacitor C1. As shown in FIG. 3, the emission period T11 resumes.

The gate-source voltage Vgs of the transistor TR2 is accurately expressed in equation (2). If the parasitic capacitance Ce1 of the organic EL element 8 is larger than each of the capacitance of the signal level maintaining capacitor C1 and the gate-source capacitance C2 of the transistor TR2, the gate-source voltage Vgs of the transistor TR2 may be set to the voltage (Vsign+Vth) with a practically sufficient accuracy.

Figure 11:
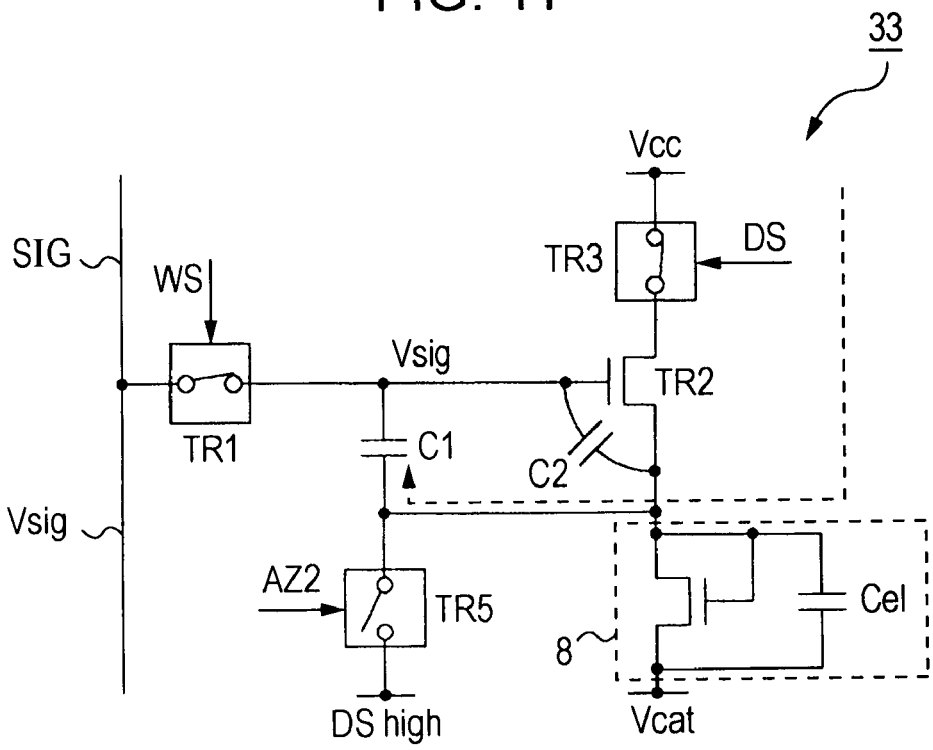
FIG. 11 is a schematic diagram illustrating a setting of the pixel performed in succession of the setting of FIG. 10.
Figure 12:
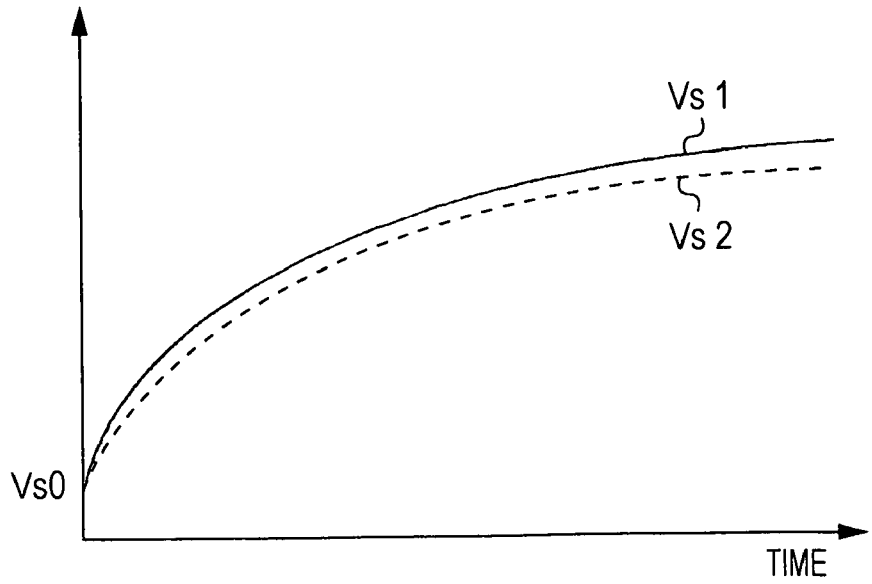
FIG. 12 illustrates a characteristic curve related to correction of a mobility.

With the drive pulse signal DS at the high voltage level, the source voltage Vs of the transistor TR2 changes depending on the mobility of the transistor TR2 within a period T15 until the falling of the write signal WS as shown in FIGS. 11 and 12. Variations in the mobility of the transistor TR2 is thus corrected.

In the display device 31 (FIG. 2), the vertical driver circuit 34 drives the scanning lines, thereby setting the signal level of the signal line SIG to the pixels 33 in the pixel section 22 on a line-by-line basis. Each pixel 33 emits light at the signal level set, and a desired image is displayed on the pixel section 22.

More specifically, the transistor TR1 is turned on in the display device 31. The signal level of the signal line SIG is thus set to the signal level maintaining capacitor C1. The transistors TR1 and TR5 are turned off while the transistor TR3 is turned on. The transistor TR2 thus causes the organic EL element 8 to emit light in response to the voltage set in the signal level maintaining capacitor C1 (during the period T11 of FIG. 2).

In the display device 31, the two terminals of the signal level maintaining capacitor C1 are respectively connected to the gate and the source of the transistor TR2 that drives the organic EL element 8, and the source of the transistor TR2 is connected to the anode of the organic EL element 8. The pixel 33 is thus formed. After the signal level of the signal line SIG is set to the signal level maintaining capacitor C1 in the display device 31, the organic EL element 8 is driven by the gate-source voltage Vgs caused by the voltage difference between the two terminals of the signal level maintaining capacitor C1. Even if all transistors of the display device 31 are N-channel type, a drop in the emission luminance due to aging of the organic EL element 8 is thus reduced.

The signal level of the signal line SIG is set to the signal level maintaining capacitor C1 with the organic EL element 8 stopping light emission. By on-off controlling the transistors TR1, TR3 and TR5, the source voltage Vs and the gate voltage Vg of the transistor TR2 driving the organic EL element 8 are set to the fixed voltages Vss and Vofs. The source voltage Vs is then gradually increased to set the voltage difference between the two terminals of the signal level maintaining capacitor C1 to the threshold voltage Vth of the transistor TR2 (periods TA, TB and TC). Furthermore, the signal level Vsig of the signal line SIG is set to the signal level maintaining capacitor C1. In this way, variations in the emission luminance due to variations in the threshold voltage Vth, as one of the characteristics of the transistor TR2, are controlled.

When the threshold voltage Vth of the transistor TR2 is set to the signal level maintaining capacitor C1, the fixed voltages Vss and Vofs need to be set to the gate and the source of the transistor TR2 at predetermined timings. Three lines of wiring pattern for the fixed voltages including the power source Vcc are necessary. The wiring pattern for the cathode voltage Vcat of the organic EL element 8 is excluded (FIG. 19).

In the display device 31, the drive pulse signal DS controls the transistor TR3, thereby controlling the supply of the power source Vcc to the transistor TR2. The drive pulse signal DS at the low voltage level is set to the fixed voltage Vss of the transistor TR2 in order to set the threshold voltage Vth of the transistor TR2 to the signal level maintaining capacitor C1. Such a drive pulse signal DS is supplied to the source of the transistor TR5.

The threshold voltage Vth of the transistor TR2 is set to the signal level maintaining capacitor C1 in the display device 31. The wiring pattern for the fixed voltage Vss to be supplied to the source of the transistor TR2 in this application can be eliminated. The number of wiring patterns for the fixed voltages is thus reduced.

The signal level of the signal line SIG is set to the signal level corresponding to the gradation of each pixel except the periods of the fixed voltage Vofs. The write signal WS and the drive pulse signal DS are also set in response to the setting of the signal level of the signal line SIG. The fixed voltage Vofs is set to the gate of the transistor TR2 via the signal line SIG when the threshold voltage Vth of the transistor TR2 is set to the signal level maintaining capacitor C1.

The wiring pattern for the fixed voltage Vofs supplying the fixed voltage Vofs to the gate of the transistor TR2 can be eliminated in the display device 31. The number of wiring patterns for the fixed voltage is thus further reduced.

Since it is sufficient if the wiring patterns for the power source Vcc and the cathode voltage Vcat are arranged for each pixel 33 in the display device 31, the pixels 33 can be arranged in a high density and efficiently. High-definition display devices can be produced at a high yield. The number of transistors forming the pixel circuit is also reduced. The pixels 33 can be arranged in an even higher density and more efficiently. High-definition display devices can be produced at an even higher yield.

The horizontal driver circuit 35 and the vertical driver circuit 34 are connected to each pixel 33 in the display device 31 so that the settings in first through fifth periods are cycled through. Within the emission period T11 as the first period, the write signal WS turns off the transistor TR1 and the drive pulse signal DS turns on the transistor TR3. The transistor TR2 is driven by the current responsive to the gate-source voltage Vgs corresponding to the voltage difference between the two terminals of the signal level maintaining capacitor C1, thereby causing the organic EL element 8 to emit light.

Within the period T12 as the second period, the transistor TR3 is turned off in response to the drive pulse signal DS, stopping the organic EL element 8 from emitting light. Within the period T13 as the third period, the transistor TR5 is turned on in response to the control signal AZ2, thereby setting the other terminal of the signal level maintaining capacitor C1 to the predetermined voltage Vss as the signal level of the drive pulse signal DS.

Within the period T14 as the fourth period, the transistor TR1 is turned on in response to the write signal WS during a period throughout which the predetermined voltage Vofs appears on the signal line SIG by a plurality of times. Within the period of each fixed voltage Vofs, the drive pulse signal DS is transitioned to the high voltage thereof, thereby setting the voltage difference between the two terminals of the signal level maintaining capacitor C1 to be approximately equal to the threshold voltage Vth of the transistor TR2. In the display device 31, the voltage across the two terminals of the signal level maintaining capacitor C1 is set to be close to the threshold voltage Vth of the transistor TR2. Even with the wiring pattern for the fixed voltage Vofs eliminated and with the transistor TR4 (FIG. 19) eliminated, the threshold voltage Vth of the transistor TR2 can be set to the signal level maintaining capacitor C1. Variations in the emission luminance in each pixel 33 are thus controlled.

Within the period T15 as the fifth period, the transistor TR1 is transitioned from the on state to the off state in response to the write signal WS, thereby setting the signal level Vsig of the signal line SIG to the one terminal of the signal level maintaining capacitor C1.

When the organic EL element 8 starts emitting light with the fifth period overtaken by the first period, the transistor TR3 is turned on in response to the drive pulse signal DS. After a predetermined time elapse, the transistor TR3 is then turned off in response to the write signal WS. This arrangement controls variations in the emission luminance due to variations in the mobility of the transistor TR2.

Variations in the emission luminance caused by variations in the threshold voltage Vth of the transistor TR2 are controlled by setting the source voltage Vs of the transistor TR2 driving the organic EL element 8 to the fixed voltage Vss. The fixed voltage Vss is set based on the signal level of the drive pulse signal DS that on-off controls the transistor TR3 supplying power to the transistor TR2. The number of wiring patterns for the fixed voltages becomes smaller than in the related art.

The signal level of the signal line SIG is set to the signal level indicating the gradation of each pixel except the fixed voltage Vofs. Along with the setting of the signal line SIG, the drive pulse signal DS is switched so that the threshold voltage Vth of the transistor TR2 is set to the signal level maintaining capacitor C1. Variations in the emission luminance due to variations in the threshold voltage Vth of the transistor TR2 are thus controlled. The number of scanning lines are reduced more. By repeating the switching of the threshold voltage Vth of the transistor TR2 by a plurality of times, the threshold voltage Vth of the transistor TR2 is set to the signal level maintaining capacitor C1 with a sufficient period of time used. Variations in the emission luminance due to variations in the threshold voltage Vth of the transistor TR2 are thus reliably prevented.

When the organic EL element 8 is driven to emit light in response to the voltage set to the signal level maintaining capacitor C1, the transistor TR1 is turned off after a constant time elapse from the rising of the drive pulse signal DS. Variations in the emission luminance due to variations in the mobility of the transistor TR2 are thus controlled.

By fabricating the pixel circuit and the driver circuit of all N-channel transistors on an insulation substrate, the display device is manufactured in a simple manufacturing process.

Figure 13:
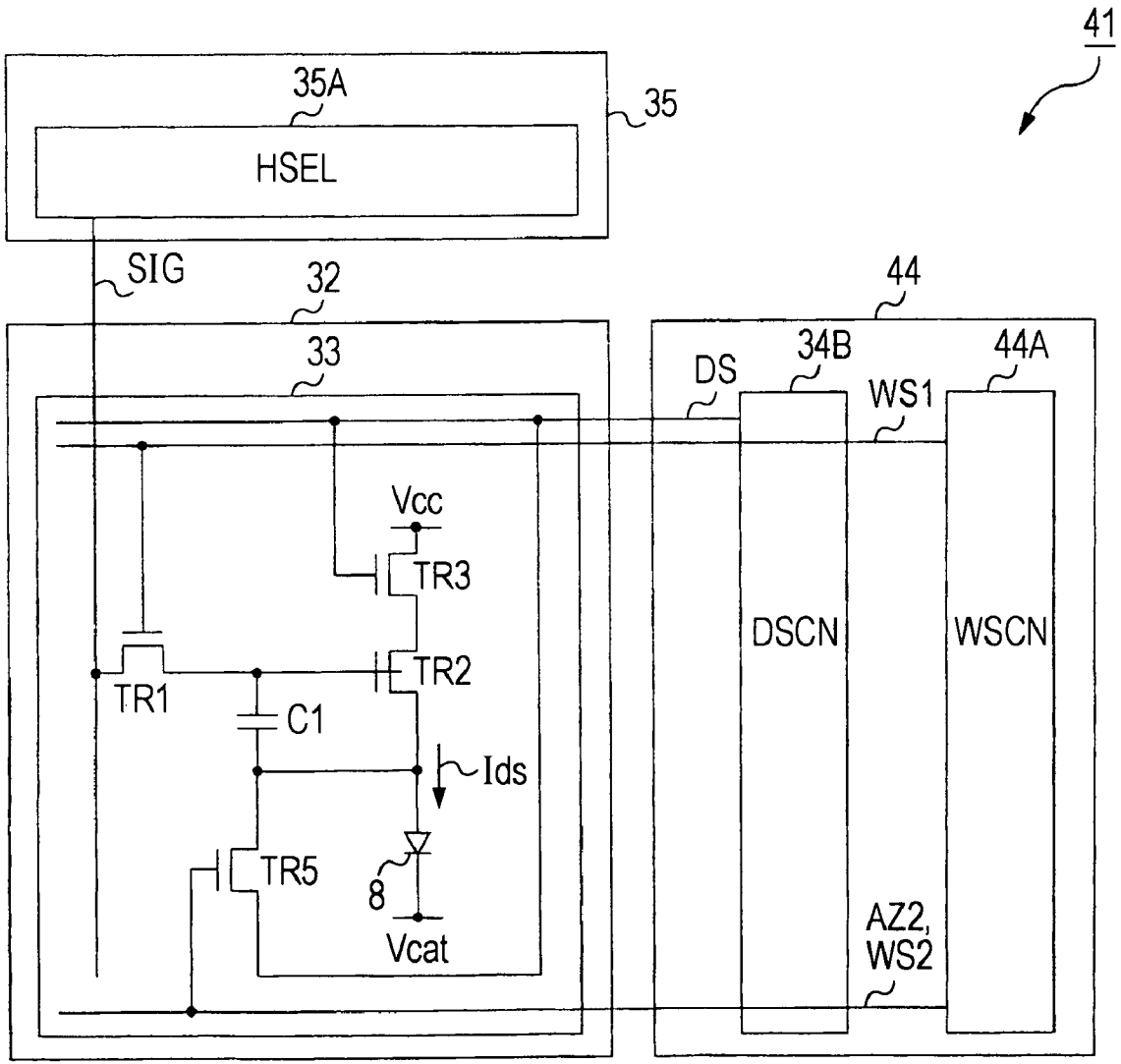
FIG. 13 is a block diagram illustrating a display device in accordance with a second embodiment of the present invention.

FIG. 13 is a block diagram illustrating a display device 41 in accordance with a second embodiment of the present invention. The display device 41 has the same structure as the display device 31 of the first embodiment except the control signal AZ2.

Figure 14:
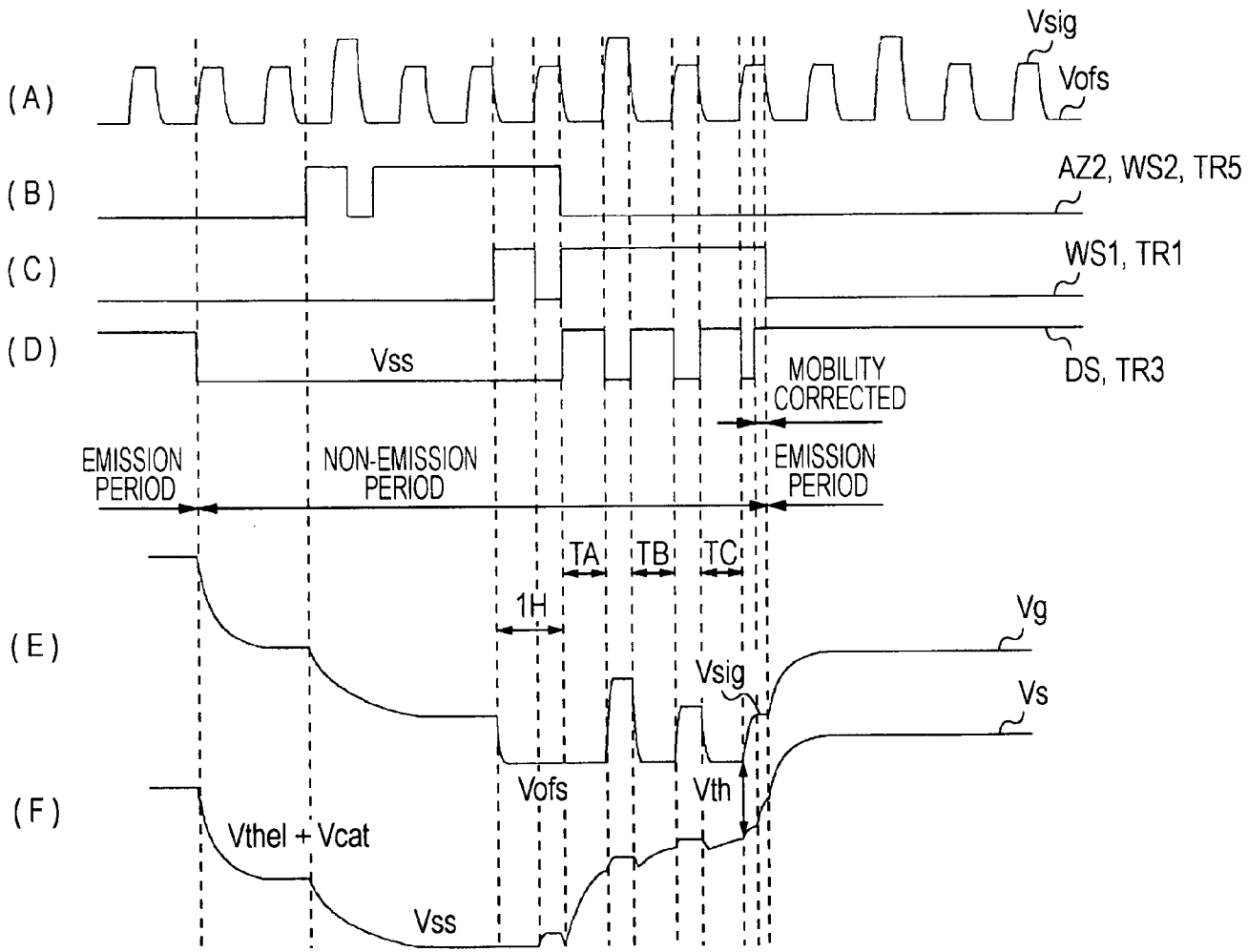
FIG. 14 is a timing diagram of the display device of FIG. 13.

A vertical driver circuit 44 in the display device 41 has no control signal generator circuit, and a write scan circuit 44A generates the control signal AZ2. As shown in FIG. 14, the write scan circuit 44A outputs as the control signal AZ2 a write signal WS2 to be output to a pixel 33 advanced by several lines via wiring to the scanning line of the pixel section 32. The write signal WS2 for one line from the write scan circuit 44A is output to the corresponding pixels 33 while being output as the control signal AZ2 to pixels 33 delayed from the corresponding pixels 33 by a plurality of lines.

The display device 41 includes a simplified version of the vertical driver circuit 44 to narrow a frame outline portion.

The write signal WS2 to be output to the pixels 33 advanced by a plurality of lines is used as the control signal AZ2. The control signal AZ2 and the write signal WS should not rise at the same time during a period throughout which the signal level of the signal line SIG is maintained at the signal level Vsig corresponding to the pixel 33. To this end, after the write signal WS rises to the high voltage level thereof within the period throughout which the signal level of the signal line SIG remains set to the fixed voltage Vofs, the write signal WS is then transitioned to the lower voltage level thereof and remains at the lower voltage level for a constant period of time within the period throughout which the signal level of the signal line SIG is maintained at the signal level Vsig corresponding to the pixel 33.

The transistor TR1 is prevented from being turned on with the control signal AZ2 keeping the transistor TR5 on. The display device 41 thus controls variations in the gate-source voltage Vgs of the transistor TR2 due to the signal level Vsig corresponding to the pixel 33 of the signal line SIG.

If the transistor TR1 is turned on with the control signal AZ2 keeping the transistor TR5 on, the gate voltage of the transistor TR2 is charged with the signal level Vsig changing from pixel to pixel. When the signal level of the signal line SIG becomes the fixed voltage Vofs next, the gate-source voltage Vgs of the transistor TR2 is expressed in the following equation (6):

$$Vgs=Vofs-Vss+(C1+C2)/(Ce1+C1+C2)\times(Vsig-Vofs) \quad (6)$$

The voltage difference between the two terminals of the signal level maintaining capacitor C1, immediately prior to the setting of the threshold voltage Vth of the transistor TR2 to the signal level maintaining capacitor C1, varies in response to the signal level Vsig of the signal line SIG.

More specifically, if the signal level Vsig of the signal line SIG is low on black side, the voltage (Vsig−Vofs) in equation (6) can take a negative value. In such a case, the gate-source voltage Vgs of the transistor TR2 becomes lower than the voltage (Vofs−Vss). Even if the fixed voltages Vofs and Vss are set to satisfy the relationship of (Vofs−Vss)>Vth, the gate-source voltage Vgs of the transistor TR2 becomes equal to or lower than the threshold voltage Vth at the moment the threshold voltage Vth is set to the signal level maintaining capacitor C1. The correct threshold voltage Vth cannot be set to the signal level maintaining capacitor C1. Because of this, the gate-source voltage Vgs of the transistor TR2 varies due to the signal level Vsig corresponding to the pixel of the signal line SIG.

As shown in FIG. 13, the write signal WS2 to be output to the pixels 33 advanced by a plurality of lines is used as the control signal AZ2. The vertical driver circuit 44 can thus be simplified.

The write signal WS is set so that the control signal AZ2 and the write signal WS may not rise concurrently during the period throughout which the signal level of the signal line SIG is maintained at the signal level Vsig of the corresponding pixel 33. The threshold voltage Vth of the transistor TR2 is thus reliably set to the signal level maintaining capacitor C1. Variations in the emission luminance due to variations in the threshold voltage Vth are reliably prevented.

In accordance with the first and second embodiments, the signal level of the signal line SIG is set with the transistor TR4 used and the fixed voltage Vofs is set for the gate voltage of the transistor TR2. The present invention is not limited to such an arrangement. As previously discussed with reference to the display device of related art, the transistor TR4 may be used to set the fixed voltage Vofs for the gate voltage of the transistor TR2.

In the above-referenced embodiments, the organic EL element as a light emitting element is current driven. The present invention is not limited to the organic EL element. The present invention is widely applicable to display devices employing a variety of current-driven light emitting elements.

Figure 29:
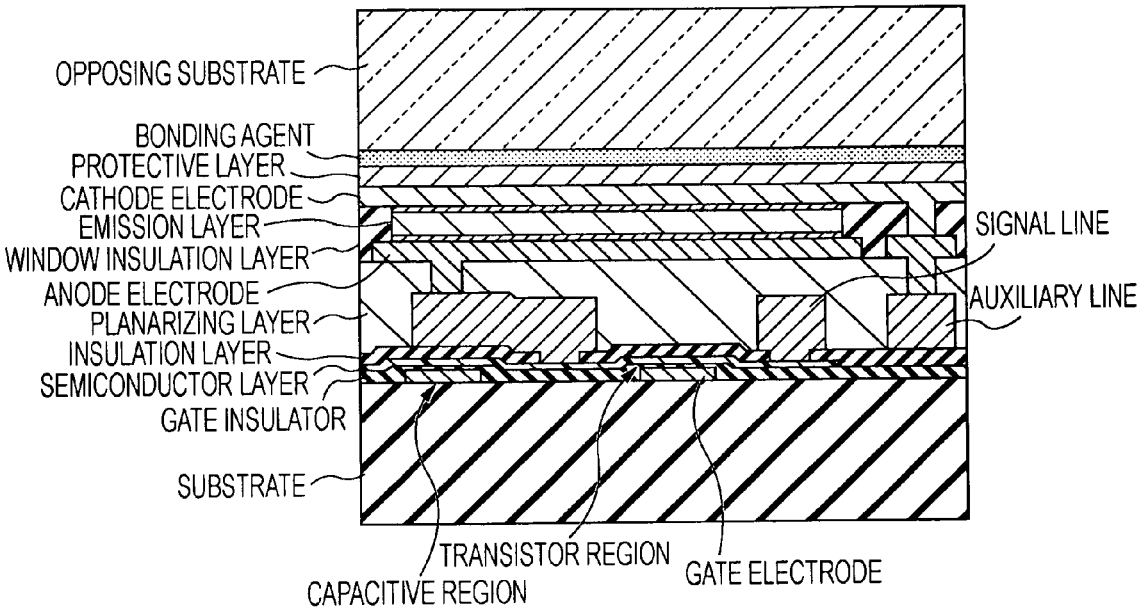
FIG. 29 is a cross-sectional view illustrating a device structure of a display device in accordance with one embodiment of the present invention.

A display device of one embodiment of the present invention is a thin-film device structure as shown in FIG. 29. FIG. 29 is a cross-sectional view diagrammatically illustrating a pixel formed on an insulation substrate. As shown, the pixel includes a transistor region containing a plurality of thin-film transistors (TFTs) (one TFT shown in FIG. 29), a capacitive region such as a storage capacitor, and a light emission region such as an organic EL element. The transistor region and the capacitive region are formed on a substrate using a TFT process. The light emission region, such as the organic EL element, is laminated on top of the transistor region and the capacitive region. An opposing substrate is then bonded on the light emission region with a bonding agent interposed therebetween to manufacture a flat panel.

Figure 30:
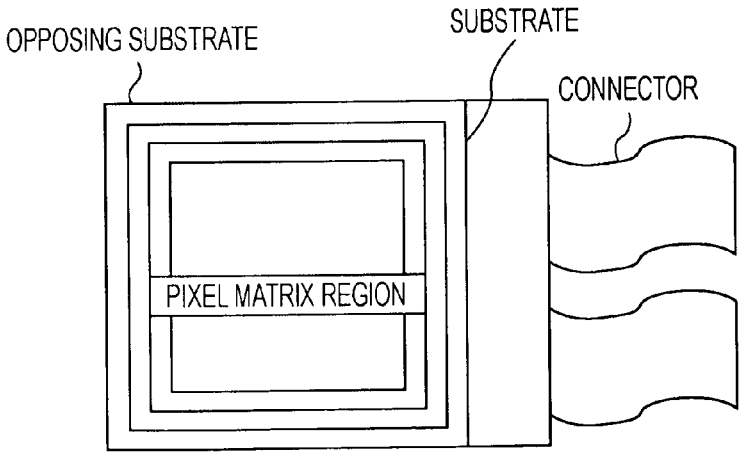
FIG. 30 is a plan view illustrating a module structure of the display device in accordance with one embodiment of the present invention.

A display device of one embodiment of the present invention is a flat-module type as shown in FIG. 30. The display device includes a pixel array section fabricated of a matrix of pixels, each pixel including an organic EL element, a thin-film transistor and a thin-film capacitor. An bonding agent is applied to surround the pixel array section, and a glass substrate as an opposing substrate is bonded onto the bonding agent to form a display module. A color filter, a protective layer, a light-blocking layer, etc. may be arranged on the transparent opposing substrate as necessary. A flexible printed circuit (FPC) may also be arranged as a connector for exchanging signals with the outside.

The display devices discussed above have a flat-panel structure and are applicable as a display of a variety of electronic apparatuses. The display device displays a video signal input to the electronic apparatus or a video signal generated in the electronic apparatus. Such electronic apparatuses include a digital camera, a notebook computer, a cellular phone and a video camera.

Figure 31:
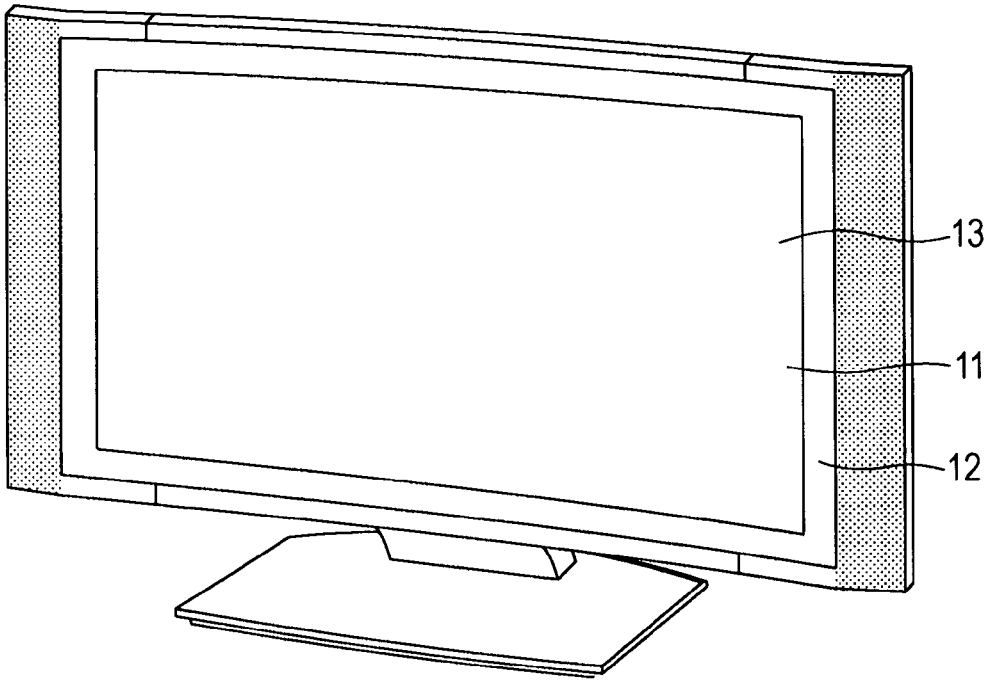
FIG. 31 is a perspective view of a television set containing the display device of one embodiment of the present invention.

A television receiver in accordance with one embodiment of the present invention of FIG. 31 includes a video display screen 11 including a front panel 12 and a filter glass 13. The display device of one embodiment of the present invention is used for the video display screen 11.

Figure 32:
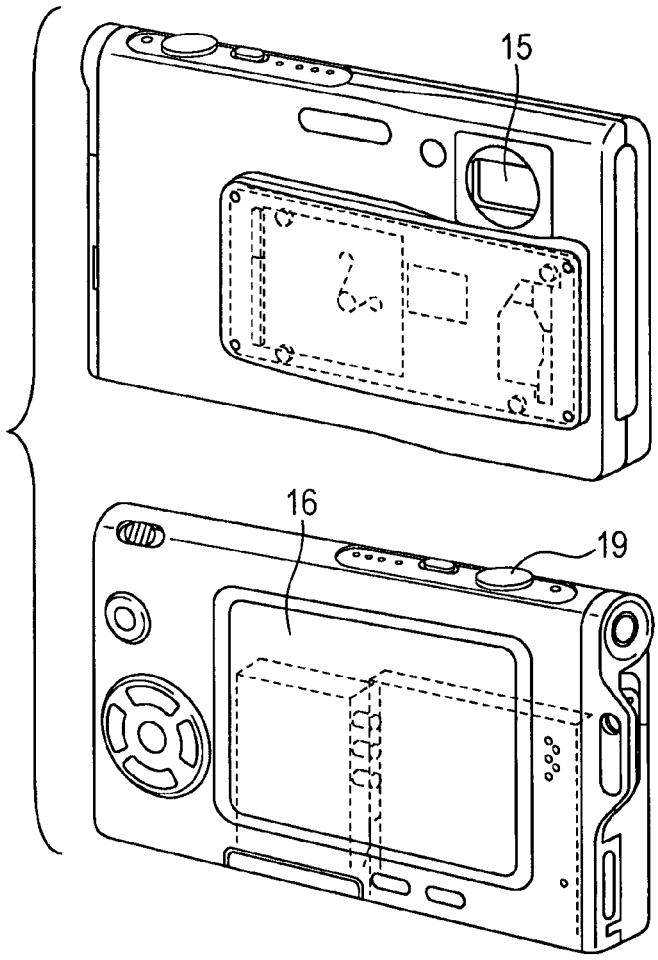
FIG. 32 is a perspective view of a digital still camera containing the display device of one embodiment of the present invention.

FIG. 32 shows a digital camera in accordance with one embodiment of the present invention. An upper portion of FIG. 32 is a front view of the digital camera and the lower portion of FIG. 32 is a rear view of the digital camera. The digital camera includes an imaging lens, a flash 15, a display 16, a control switch, a menu switch, a shutter 19, etc. The display device of one embodiment of the present invention may be used for the display 16.

Figure 33:
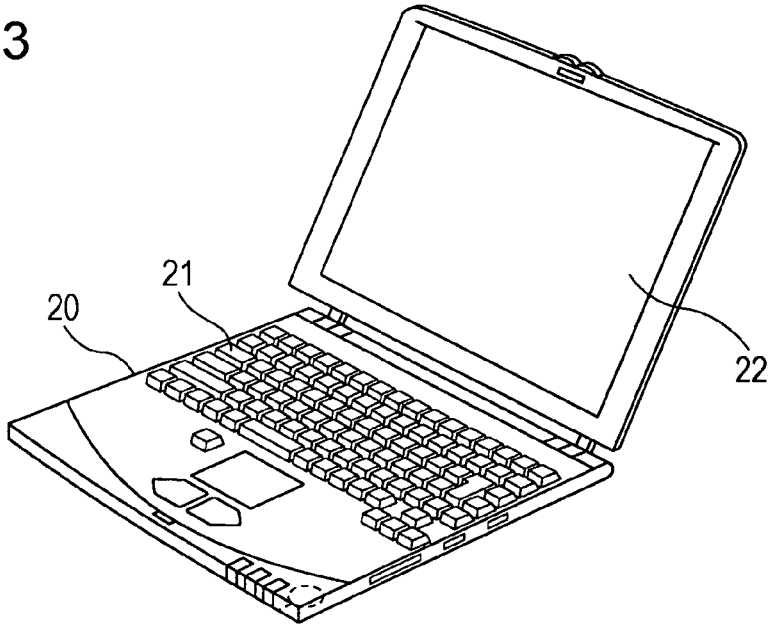
FIG. 33 is a perspective view of a notebook personal computer containing the display device of one embodiment of the present invention.

A notebook personal computer of FIG. 33 includes a keyboard 31 to be operated to input text or the like onto a main unit 20, and a display 22 on the cover of the main unit for displaying an image. The display device of one embodiment of the present invention may be used for the display 22.

Figure 34:
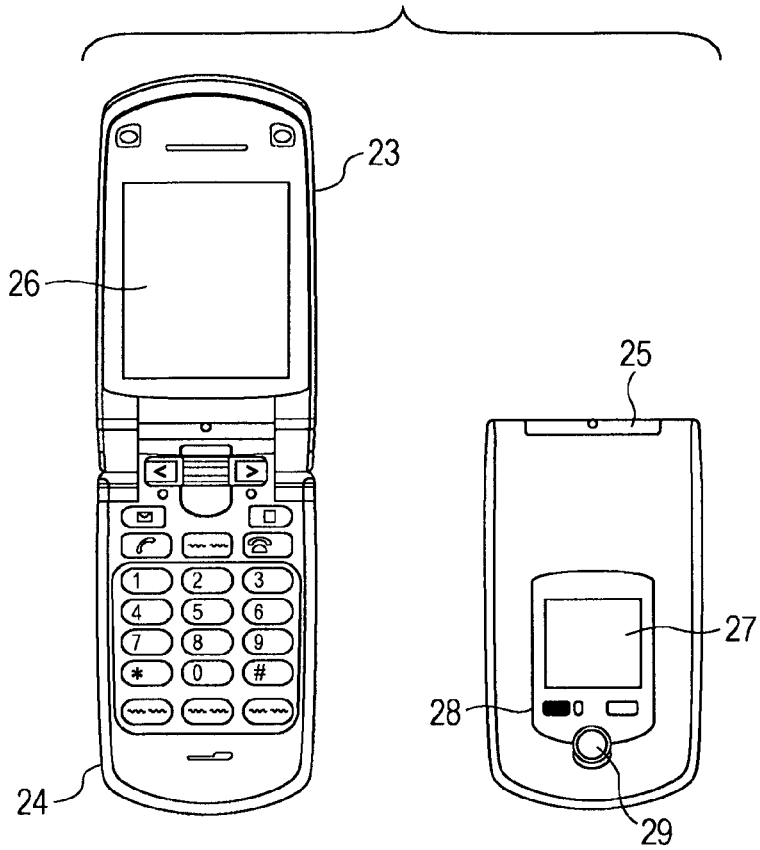
FIG. 34 diagrammatically illustrates a cellular phone containing the display device of one embodiment of the present invention.

FIG. 34 illustrates a cellular phone. The left portion of FIG. 34 illustrates the cellular phone in the open state thereof and the right portion of FIG. 34 illustrates the cellular phone in the closed state thereof. The cellular phone includes a top side casing 23, a bottom side casing 24, an hinge portion 25, a display 26, a sub-display 27, a picture light 28, a camera 29, etc. The display device of one embodiment of the present invention may be used for one of the display 26 and the sub display 27.

Figure 35:
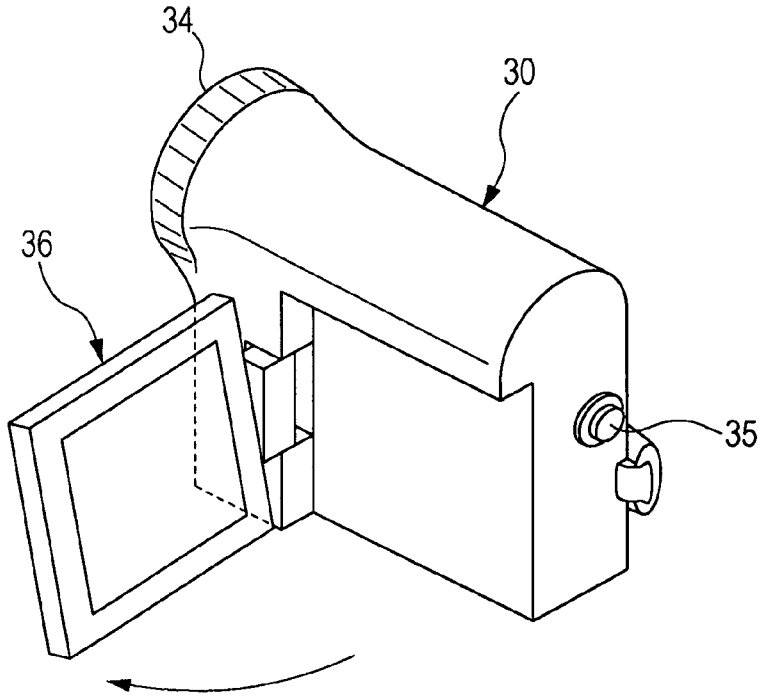
FIG. 35 diagrammatically illustrates a video camera containing the display device of one embodiment of the present invention.

A video camera of FIG. 35 includes a main unit 30, an imaging lens 34 facing frontward in the open state thereof, a start/stop switch 35 for photographing, a monitor 36, etc. The display device of one embodiment of the present invention may be used for the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising a pixel circuit of a matrix of pixels and a driver circuit for driving the pixel circuit, the driver circuit including a write scan circuit that generates a write signal, and a drive scan circuit that generates a drive pulse signal, each pixel including:

a signal level maintaining capacitor;

a first transistor, turned on and off in response to the write signal, for connecting one terminal of the signal level maintaining capacitor to a signal line;

a second transistor having a gate thereof directly connected to the one terminal of the signal level maintaining capacitor and a source thereof directly connected to the other terminal of the signal level maintaining capacitor;

a current-driven self-luminous element with a cathode thereof held at a cathode voltage and an anode thereof connected to the source of the second transistor;

a third transistor, turned on and off in response to the drive pulse signal, for connecting a drain of the second transistor to a power source voltage; and a fourth transistor connected to the other terminal of the signal level maintaining capacitor, the fourth transistor receiving the drive pulse signal at the source thereof with the drain thereof connected to the other terminal of the signal level maintaining capacitor, being turned on in response to a control signal applied to the gate thereof, and setting the other terminal of the signal level maintaining capacitor to a signal level of the drive pulse signal.

2. A display device according to claim 1, wherein the driver circuit sets the signal level of the signal line to a signal level corresponding to a gradation of each pixel connected to the signal line except during a fixed voltage period, and drives the pixel circuit with settings in first through fifth periods repeatedly cycled through, wherein within the first period, the write signal, the drive pulse signal and the control signal turn on and off the first transistor, the third transistor and the fourth transistor respectively so that a current responsive to a gate-source voltage across the two terminals of the signal level maintaining capacitor causes the second transistor to drive the self-luminous element to emit light, wherein within the second period, the third transistor is turned off in response to the drive pulse signal to cause the self-luminous element to stop light emission, wherein within the third period, the fourth transistor is turned on in response to the control signal, thereby setting the other terminal of the signal level maintaining capacitor to the signal level of the drive pulse signal, wherein the first transistor is turned on in response to the write signal during part of the fourth period throughout which a predetermined fixed voltage repeatedly appears on the signal line, and the third transistor is turned on during part of the fourth period throughout which the signal level of the signal line is set to the predetermined fixed voltage so that the voltage across the two terminals of the signal level maintaining capacitor is set to a voltage substantially equal to a threshold voltage of the second transistor, and wherein within the fifth period, the first transistor is turned off in response to the write signal so that the signal level of the signal line is set to the one terminal of the signal level maintaining capacitor.

3. The display device according to claim 2, wherein the driver circuit causes the first transistor to turn off in response to the write signal after a constant period of time has elapsed since turn-on of the third transistor in response to the drive pulse signal within the fifth period.

4. The display device according to claim 2, wherein the driver circuit outputs as the control signal the write signal to be output to a pixel advanced by a plurality of lines.

5. The display device according to claim 1, wherein the driver circuit outputs an other write signal to a pixel advanced by a plurality of lines in a manner such that the first transistor and the fourth transistor are not turned concurrently on during a period throughout which the signal level of the signal line is maintained at a signal level corresponding to a gradation of a pixel connected to the signal line.

6. The display device according to claim 1, wherein all transistors contained in the pixel circuit and the driver circuit are N-channel type transistors and wherein each of the pixel circuit and the driver circuit is formed on an insulating substrate using an amorphous silicon process.

7. An electronic apparatus, comprising:

a display device comprising a pixel circuit of a matrix of pixels and a driver circuit for driving the pixel circuit, the driver circuit including a write scan circuit that generates a write signal, and a drive scan circuit that generates a drive pulse signal, each pixel including:

a signal level maintaining capacitor;

a first transistor, turned on and off in response to the write signal, for connecting one terminal of the signal level maintaining capacitor to a signal line;

a second transistor having a gate thereof directly connected to the one terminal of the signal level maintaining capacitor and a source thereof directly connected to the other terminal of the signal level maintaining capacitor;

a current-driven self-luminous element with a cathode thereof held at a cathode voltage and an anode thereof connected to the source of the second transistor;

a third transistor, turned on and off in response to the drive pulse signal, for connecting a drain of the second transistor to a power source voltage; and a fourth transistor connected to the other terminal of the signal level maintaining capacitor, the fourth transistor receiving the drive pulse signal at the source thereof with the drain thereof connected to the other terminal of the signal level maintaining capacitor, being turned on in response to a control signal applied to the gate thereof, and setting the other terminal of the signal level maintaining capacitor to a signal level of the drive pulse signal.

8. The electronic apparatus according to claim 7, wherein the driver circuit sets the signal level of the signal line to a signal level corresponding to a gradation of each pixel connected to the signal line except during a fixed voltage period, and drives the pixel circuit with settings in first through fifth periods repeatedly cycled through, wherein within the first period, the write signal, the drive pulse signal and the control signal turn on and off the first transistor, the third transistor and the fourth transistor respectively so that a current responsive to a gate-source voltage across the two terminals of the signal level maintaining capacitor causes the second transistor to drive the self-luminous element to emit light, wherein within the second period, the third transistor is turned off in response to the drive pulse signal to cause the self-luminous element to stop light emission, wherein within the third period, the fourth transistor is turned on in response to the control signal, thereby setting the other terminal of the signal level maintaining capacitor to the signal level of the drive pulse signal, wherein the first transistor is turned on in response to the write signal during part of the fourth period throughout which a predetermined fixed voltage repeatedly appears on the signal line, and the third transistor is turned on during part of the fourth period throughout which the signal level of the signal line is set to the predetermined fixed voltage so that the voltage across the two terminals of the signal level maintaining capacitor is set to a voltage substantially equal to a threshold voltage of the second transistor, and wherein within the fifth period, the first transistor is turned off in response to the write signal so that the signal level of the signal line is set to the one terminal of the signal level maintaining capacitor.

9. The electronic apparatus according to claim 8, wherein the driver circuit causes the first transistor to turn off in response to the write signal after a constant period of time has elapsed since turn-on of the third transistor in response to the drive pulse signal within the fifth period.

10. The electronic apparatus according to claim 8, wherein the driver circuit outputs as the control signal the write signal to be output to a pixel advanced by a plurality of lines.

11. The electronic apparatus according to claim 7, wherein the driver circuit outputs an other write signal to a pixel advanced by a plurality of lines in a manner such that the first transistor and the fourth transistor are not turned concurrently on during a period throughout which the signal level of the signal line is maintained at a signal level corresponding to a gradation of a pixel connected to the signal line.

12. The electronic apparatus according to claim 7, wherein all transistors contained in the pixel circuit and the driver circuit are N-channel type transistors and wherein each of the pixel circuit and the driver circuit is formed on an insulating substrate using an amorphous silicon process.

* * * * *